US008267496B2

(12) United States Patent
Kanda et al.

(10) Patent No.: US 8,267,496 B2
(45) Date of Patent: Sep. 18, 2012

(54) PRINTER

(75) Inventors: Mitsuhiro Kanda, Nagoya (JP); Yuji Iida, Chita (JP); Yuichiro Suzuki, Komaki (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 252 days.

(21) Appl. No.: 12/836,930

(22) Filed: Jul. 15, 2010

(65) Prior Publication Data

US 2011/0018918 A1 Jan. 27, 2011

(30) Foreign Application Priority Data

Jul. 22, 2009 (JP) ..... 2009-170989
May 7, 2010 (JP) ..... 2010-107339

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

| | | | |
|---|---|---|---|
| RE35,175 | E | 3/1996 | Yamaguchi |
| 2003/0077099 | A1 | 4/2003 | Tanaka et al. |
| 2009/0162125 | A1 | 6/2009 | Kubota |

FOREIGN PATENT DOCUMENTS

| | | | |
|---|---|---|---|
| JP | 5-38854 | A | 2/1993 |

OTHER PUBLICATIONS

Extended European Search Report for Application No. EP 10 25 1211 dated Dec. 14, 2010.

*Primary Examiner* — Stephen Meier
*Assistant Examiner* — Tracey McMillion
(74) *Attorney, Agent, or Firm* — Scully, Scott, Murphy & Presser, PC

(57) ABSTRACT

In case resolution is set to 360 dpi, each dot is formed on each printing line provided orthogonally to conveying direction at intervals obtained by dividing an inch on a surface tape by 360 lines. Contrarily, in case resolution is set to 180 dpi, each dot array is formed to occupy two printing lines. In case a control unit judges that the number of dot-array-formed printing lines from start of printing till temporary stop of printing with 180 dpi is not equal to that of dot-array-formed printing lines with 360 dpi, a portion of serial arrays of dots to be formed from start of printing till temporary stop of printing with 180 dpi is formed with 360 dpi so that the number of dot-array-formed printing lines from start of printing till temporary stop of printing is made equal to that of dot-array-formed printing lines in printing with 360 dpi.

4 Claims, 13 Drawing Sheets

PRINTER

CROSS REFERENCE TO RELATED APPLICATIONS

The present application claims priority from Japanese Patent Applications No. JP 2009-170989 which was filed on Jul. 22, 2009 and No. 2010-107339 which was filed on May 7, 2010, the disclosure of which is incorporated herein by reference in its entirety.

TECHNICAL FIELD

The disclosure relates to a printer that includes: a conveyer unit for conveying a printing medium that is long sized; a printing head for carrying out printing on the printing medium that is conveyed, the printing being carried out by forming each array of dots aligned on each of a plurality of printing lines, the printing lines being in orthogonal direction to a conveying direction and provided at intervals obtained by dividing a unit length of the printing medium by resolution; and a cutter that is arranged at downstream of the conveying direction in comparison with the printing head.

BACKGROUND

There have conventionally been proposed various printers characterized by including: a conveyer unit for conveying a printing medium that is long sized; a printing head for carrying out printing on the printing medium that is conveyed, the printing being carried out by forming each array of dots aligned on each of a plurality of printing lines, the printing lines being in orthogonal direction to a conveying direction and provided at intervals obtained by dividing a unit length of the printing medium by resolution; and a cutter that is arranged at downstream of the conveying direction in comparison with the printing head. A conventional printer of this kind is forced to arrange its cutter and printing head apart from each other by predetermined distance due to its structural restriction. Therefore, when a cutter is to cut off a front margin of the printing medium to be formed so as to start from a point of a start of printing in a direction reverse to a printing direction, the printing head is supposed to be located at a printing-half-done position. Therefore, the printing head has to stop printing temporarily so as to allow the cutter to cut off the front margin and resume printing after the front margin is cut off, which is termed as successive printing and disclosed in prior art.

By the way, among printers which are capable of printing successively as well as printing with two or more of resolution types such as high resolution and low resolution, there is a printer which prints each dot arrays with high resolution on one printing line provided at intervals obtained by dividing a unit length of a printing medium by a numerical value corresponding to high resolution, whereas prints each dot arrays with low resolution so as to occupy a plurality of those printing lines.

For instance, FIG. 14 shows dot patterns formed with a printing head of a printer that is capable of printing with two resolution types, namely, 360 dpi and 180 dpi. In FIG. 14, each single dot represents an array of dots in a tape width direction. Hereinafter, a single dot in FIG. 4 and FIG. 10 is regarded as an array of dots in the following descriptions. (A) is a dot pattern printed with 360 dpi, wherein each dot array is formed on a single printing lines a. The printing lines a are provided at intervals of a length (approximately 0.07 mm) obtained by dividing an inch on a printing medium by the numerical value of 360. On the other hand, as indicated at (B) and (C), each dot array of dot patterns printed with 180 dpi is formed so as to occupy two printing lines a. Therefore, a conveying-directional length of a dot with 180 dpi is twice as that of dot with 360 dpi.

In the above such printer that is capable of printing successively, for allowing the cutter to cut off a front margin, the printing head cannot stop printing temporarily at a half-done position for forming a dot array. Consequently, in case the printer is capable of printing with two or more resolution types such as high resolution and low resolution, length of a front margin to be cut off may differ depending on printing with high resolution or low resolution.

For instance, it is given that a length of a front margin to be cut off is set to 1 as reference value thereof in case of printing with 360 dpi as indicated at (A) in FIG. 14. In case of printing with 360 dpi, the printing head is positioned at a period of forming a dot array when the cutter is at a position to make the length of the front margin 1. Therefore, printing operation can be stopped thereat exactly.

With respect to (A) in FIG. 14, the number of dot arrays (i.e., the number of printing lines a) to be formed from start of printing till temporary stop of printing is an odd number. Thereby, in case of printing with 180 dpi at (B) in FIG. 14, the printing head is positioned at a half-done position for forming a dot array even though the cutter is at a position to make the length of the front margin 1 that is the same the case of (A) in FIG. 14. That is the printing head is at a half-done position for forming a dot array that occupies two printing lines a. Therefore, unless formation of the dot is finished, temporary stop of printing is not allowed prior to the temporary stop in a fashion as indicated at (C) in FIG. 14. In this case, as apparent by making comparison with (A) and (C) in FIG. 14, the number of dot-array-formed printing lines a from the start of printing till the temporary stop of printing with 360 dpi differs from that of "dot-array-formed printing lines a" printed with 180 dpi. The difference means that the printing length printed from the start of printing till the temporary stop of printing with 180 dpi differs from the printing length printed with 360 dpi. The length of the front margin 1 to be cut off at the time of temporary stop of printing is determined by conveying distance that the printing medium is conveyed between the cutter and the printing head, and printing length printed from the start of printing till temporary stop of printing. Therefore, length of the front margin for printing with 180 dpi differs from that of the front margin with 360 dpi.

SUMMARY

The disclosure has been made to solve the above-described problem. The object of the disclosure is to provide a printer capable of resolving difference of front margin length that occurs in case a printer has both a high resolution printing function and a low resolution printing function.

According to one aspect of the disclosure, there is provided a printer comprising: a conveyer unit for conveying a printing medium that is long sized; a printing head for carrying out printing on the printing medium that is conveyed, the printing being carried out by forming each array of dots aligned on each of a plurality of printing lines, the printing lines being in orthogonal direction to a conveying direction and provided at intervals obtained by dividing a unit length of the printing medium by resolution; and a cutter that is arranged at downstream of the conveying direction in comparison with the printing head, wherein the printing head carries out temporary stop of printing for allowing the cutter to cut off a front margin of the printing medium, the front margin being formed so as to start from a point of a start of printing in a direction reverse to a printing direction, wherein the resolution includes first resolution and second resolution, first printing lines are provided at intervals obtained by dividing the unit length by a numerical value of the first resolution and a dot array with the second resolution is formed so as to occupy two or more of first printing lines, wherein the printer further comprises a judgment unit that judges whether or not number of dot-array-formed first printing lines from the start of printing till the temporary stop of printing with the second resolution is equal to number of dot-array-formed first printing lines in printing with the first resolution, each of the dot-array-formed first printing lines being a first printing lines on which an array of full-dots or an array of dot portions is formed, and wherein, in case the judgment unit judges that the number of the dot-array-formed first printing lines in printing with the second resolution is not equal to the number of the dot-array-formed first printing lines in printing with the first resolution, a portion of serial arrays of dots to be formed from the start printing till the temporary stop of printing with the second resolution is formed with the first resolution so that the number of the dot-array-formed first printing lines is made equal to the number of the dot-array-formed first printing lines in printing with the first resolution.

DETAILED DESCRIPTION

Detailed descriptions of two exemplary embodiments of a printer 1 directed to the disclosure will now be given by referring to the accompanying drawings, the printer 1 carrying out printing on a tape fed from a tape cassette. First, the schematic structure of the printer 1 directed to the first embodiment will be described by referring to FIG. 1 through FIG. 9.

Figure 1:
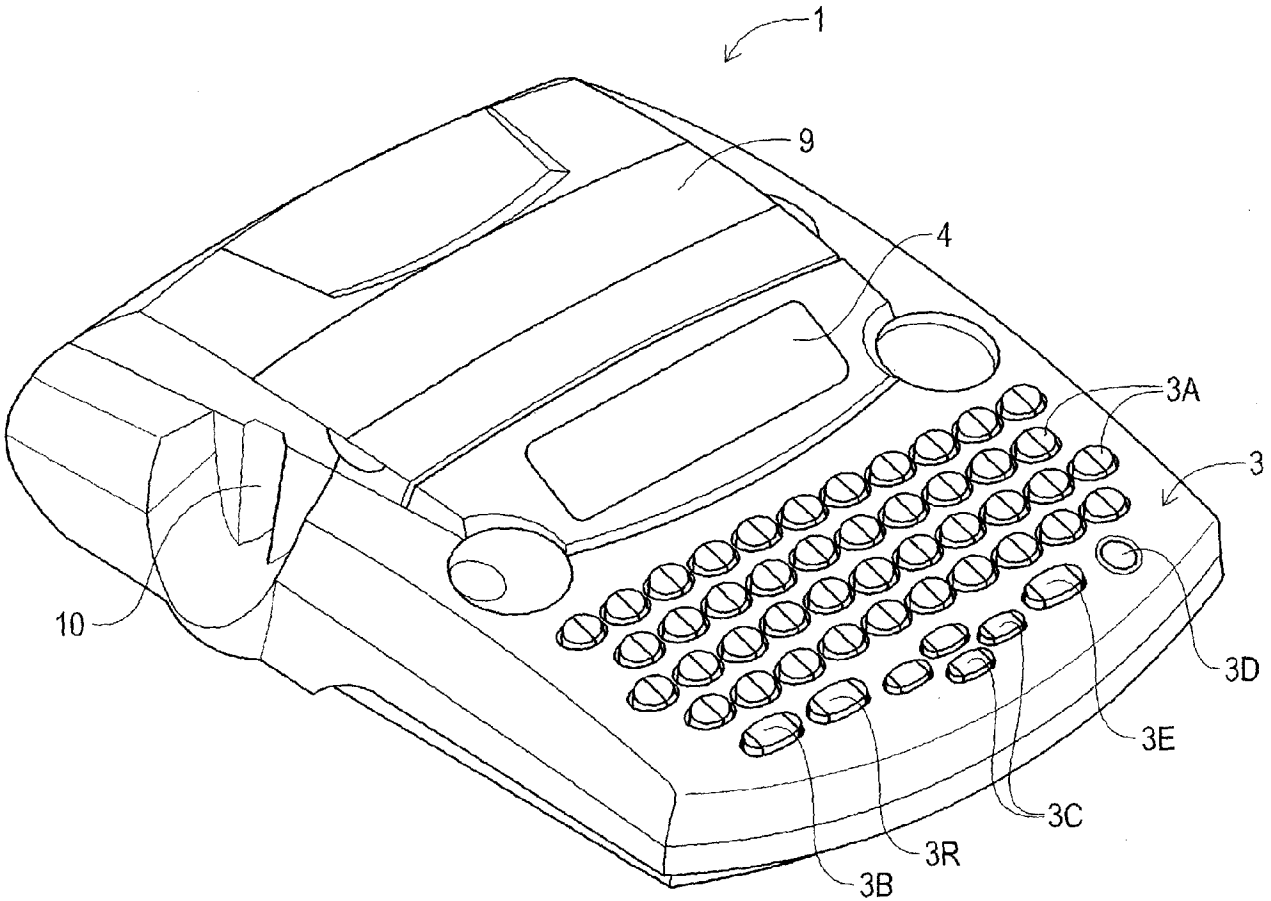
FIG. 1 is a perspective view of a printer directed to a first embodiment.

As shown in FIG. 1, the printer 1 directed to the first embodiment is a printer for carrying out printing on a tape fed from a tape cassette 5 (refer to FIG. 2) housed inside a cabinet of the printer 1. The printer 1 includes a keyboard 3 and a liquid crystal display 4 on the top of the cabinet. Further, a cassette holding portion 8 for holding the tape cassette 5 that is a rectangular shape when seen from top is loaded inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface 71 (refer to FIG. 3) is arranged at the right side of the printer 1. The connection interface 71 is used for connecting the printer 1 to an external apparatus 78 (e.g., a personal computer, etc., refer to FIG. 3) in a manner of either wireline connection or wireless connection. Accordingly, the printer 1 is capable of printing out printing data transmitted from the external apparatus 78.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power of the main body of the printer 1. The return key 3R is operated for executing a line feeding instruction or various processing and for determining a choice from candidates. The liquid crystal display 4 is a display device for indicating characters such as letters, etc. in plural lines, i.e., displaying printing data created by the keyboard 3.

It is to be noted that, in the printer 1 directed to the first embodiment, printing resolution can be set to either 180 dpi or 360 dpi. More specifically, by operating the setting key 3E, printing resolution can be set to either 360 dpi (high resolution) or 180 dpi (low resolution). Printing resolution currently set for the printer 1 is stored in an EEPROM 63 to be described later.

Figure 2:
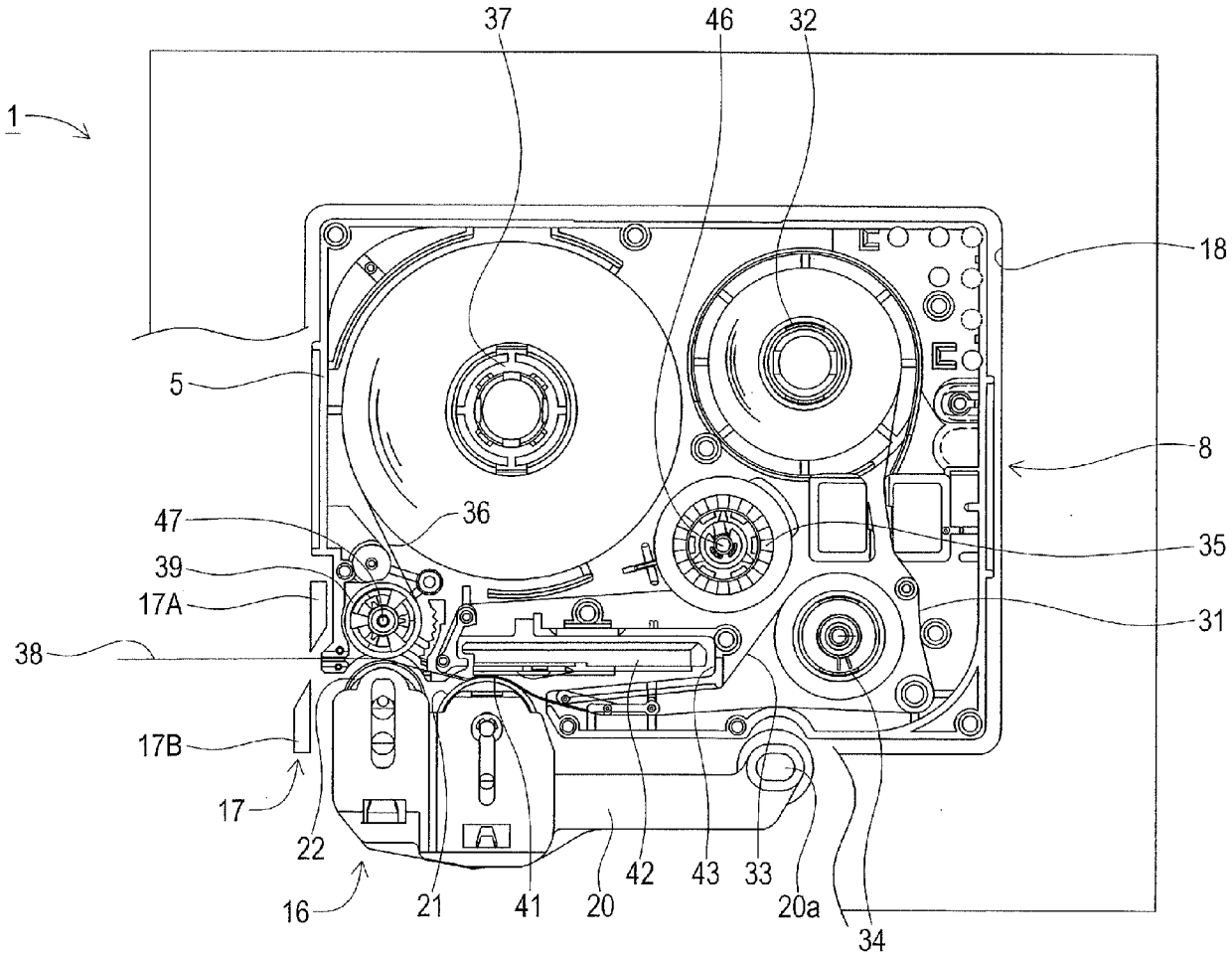
FIG. 2 is a top plan view showing a vicinity of a cassette holding portion for the printer directed to the first embodiment.
Figure 3:
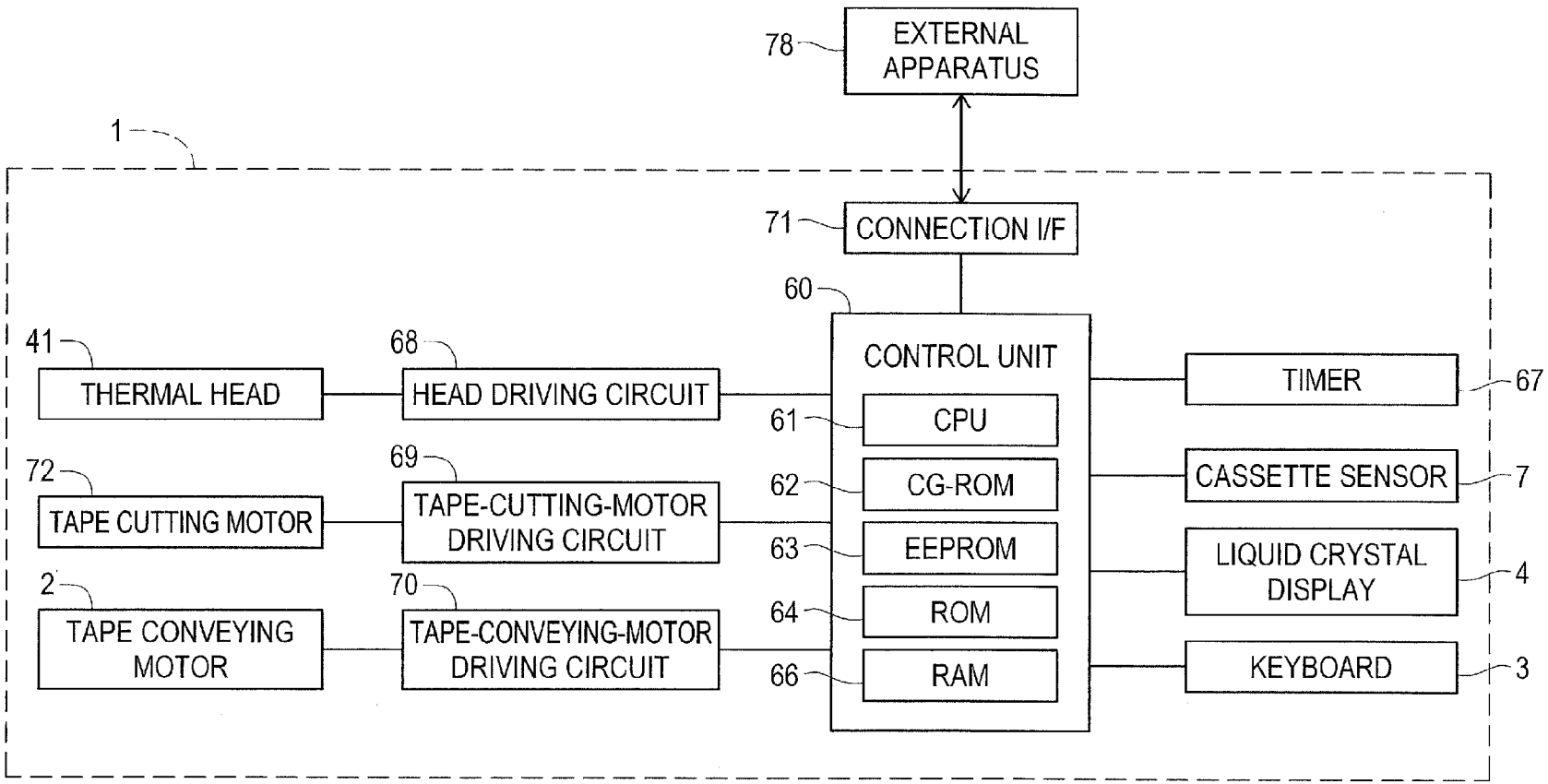
FIG. 3 is a block diagram showing control system of the printer directed to the first embodiment.

As shown in FIG. 2, the printer 1 is configured such that the tape cassette 5 can be loaded in the cassette holding portion 8 arranged inside thereof. Further, inside the printer 1, tape cutting mechanism including a tape driving and printing mechanism 16 and a cutter 17 is arranged. The printer 1 is capable of carrying out printing onto a tape fed from the tape cassette 5 by the tape driving and printing mechanism 16 in accordance with desired printing data. Further, the printer 1 is capable of cutting off a printed part of a tape with the cutter 17 constituting the tape cutting mechanism. The printed part of the tape thus cut off is ejected from the tape ejecting portion 10 formed on the left side of the printer 1.

Inside the printer 1, a cassette holding frame 18 is arranged. As shown in FIG. 2, the tape cassette 5 is loaded into the cassette holding frame 18 in a removable and replaceable manner.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is made of a transparent tape such as PET (polyethylene terephthalate) film or the like. An ink ribbon 33 is wound around the ribbon feeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond the surface tape 31 and a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is put outside. The bonding roller 39 is used for bonding the double tape 36 and the surface tape 31 together.

As shown in FIG. 2, in the cassette holding frame 18, an arm 20 is arranged around a shaft 20*a* in a pivotal manner. A platen roller 21 and a conveying roller 22 are rotatably supported at the front edge of the arm 20. Both the platen roller 21 and the conveying roller 22 employ a flexible member made of rubber or the like for their surfaces.

When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

A plate 42 is arranged upright inside the cassette holding frame 18. The plate 42 includes a thermal head 41 at its side surface facing the platen roller 21. The thermal head 41 consists of a plurality (e.g. 128 or 256) of heater elements 41*a* aligned in the width direction of the surface tape 31 and the double tape 36. When the tape cassette 5 is placed in a predetermined position, the plate 42 is fitted in a concave portion 43 of the tape cassette 5.

Further, as shown in FIG. 2, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

In the cassette holding frame 18, there is arranged a tape conveying motor 2 (refer to FIG. 3) composed of a stepping motor. Driving force of the tape conveying motor 2 is transmitted to the platen roller 21, the conveying roller 22, the ribbon-take-up roller 46 and the bonding-roller driving roller 47, etc. via series of gears arranged along the cassette holding frame 18.

Accordingly, when rotation of the tape conveying motor 2 is started with supply of power to the tape conveying motor 2, rotation of the used-ribbon-take-up spool 35, the bonding roller 39, the platen roller 21 and the conveying roller 22 is started in conjunction with the operation of the tape conveying motor 2. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, the surface tape 31 and the ink ribbon 33 are conveyed in a state that portions of the surface tape 31 in contact with an ink layer of the ink ribbon 33 are pressed by the platen roller 21 and the thermal head 41. The significant number of the heater elements aligned on the thermal head 41 are selectively and intermittently energized by a control unit 60 (refer to FIG. 3) in accordance with printing data.

Each heater element gets heated by power supply and melts or sublimes ink applied on the ink ribbon 33. Therefore, ink in the ink layer on the ink ribbon 33 is transferred onto the surface tape 31 in a certain unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the bonding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 so as to reach the tape cutting mechanism including the cutter 17. The tape cutting mechanism consists of the cutter 17 and the tape cutting motor 72 (refer to FIG. 3). The cutter 17 includes a fixed blade 17*a* and a rotary blade 17*b*. More specifically, the cutter 17 is a scissors-like cutter that cuts off an object to be cut off by rotating the rotary blade 17*b* against the fixed blade 17*a*. The rotary blade 17*b* is arranged so as to be able to rotate back and forth with reference to a shaft thereof with the aid of the tape cutting motor 72. Accordingly, the laminated tape 38 is cut off with the fixed blade 17*a* and the rotary blade 17*b* along operation of the tape cutting motor 72.

The cutter 17 is controlled to automatically cut off a laminated tape 38 taking a front margin and rear margin. The front margin is formed by predetermined length so as to start from a point of start of printing in a direction reverse to a printing direction and the rear margin is formed by predetermined length so as to start from a point of end of printing in the printing direction. Conveying distance n to convey the surface tape 31 from the thermal head 41 to the cutter 17 is made longer than the predetermined length of the front margin. Therefore, when the cutter 17 cuts off the laminated tape 31 for the front margin, the thermal head 41 is positioned at a printing-half-done position. Consequently, printing operation has to be stopped at the end of the last printed dot before the temporary stop, thereby conveyance of the tape is stopped and the front margin thereof is cut off by the cutter, as will be described later.

The laminated tape 38 thus cut off is ejected outside of the printer 1 via the tape ejecting portion 10. By peeling off the release paper from the double tape 36 and exposing the adhesive agent layer, the laminated tape 38 can be used as adhesive label that can be adhered to an arbitrary place.

Next, there will be described on a control configuration of the printer 1 by referring to drawings.

Inside the printer 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69 and the tape-conveying-motor driving circuit 70. The control unit 60 is also connected to a liquid crystal display 4, a cassette sensor 7, a keyboard 3 and a connection interface 71.

The CG-ROM 62 is a character generator memory wherein image data of to-be-printed letters and sign are associated with code data and stored in dot patterns. The EEPROM 63 is a non-volatile memory that allows data write for storing therein and deletion of stored data therefrom.

The ROM 64 stores various control programs and various data for the printer 1. Accordingly, each program to be described later of the before-printing process and the like are stored in the ROM 64.

The RAM 66 is a storing device for temporarily storing a processing result of the CPU 61 etc. The RAM 66 also stores printing data created with inputs by means of the keyboard 3, printing data taken therein from an external apparatus 78 via the connection interface 71. Further, the RAM 66 stores a half dot mode determination flag that is set to ON or OFF. The half dot mode determination flag is a flag for determining whether or not to execute a half dot process to be described later.

The timer 67 is a time-measuring device that measures passage of predetermined length of time for executing control of the printer 1. More specifically, the timer 67 is referred for detecting start and termination of an energization period for a heater element of the thermal head 41.

The CPU 61 is a central processing unit that plays a primary role for various system control of the printer 1. The CPU 61 makes up printing data for forming dots with heater elements in accordance with letter string information inputted with the letter inputting keys 3A. More specifically, the CPU 61 creates printing data (image data constituted by dot data) based on a letter string inputted with the letter input keys 3A, printing format previously selected and dot patterns stored in the CG-ROM 62. After that, the CPU 61 divides the thus created printing data into a plurality of line printing data, wherein each line printing data corresponds to a single line to be printed with a line of heater elements aligned on the thermal head 41. The CPU 61 stores the plurality of line printing data in the RAM 66. In case printing resolution is set to 360 dpi (high resolution), the CPU 61 divides printing data to create 360 line printing data per inch. In case printing resolution is set to 180 dpi (low resolution), the CPU 61 divides printing data to create 180 line printing data per inch.

The head driving circuit 68 is a circuit that serves to supply a driving signal to the thermal head 41 in response to a control signal from the CPU 61 for controlling operation manners of the thermal head 41. In this connection, the head driving circuit 68 controls to energize and de-energize each of the heater elements based on a strobe number associated with each heater element for comprehensively controlling heating manner of the thermal head 41. The tape-cutting-motor driving circuit 69 is a circuit that serves to supply a driving signal to the tape cutting motor 72 in response to a control signal from the CPU 61 for controlling operation of the tape cutting motor 72. Further, the tape-conveying motor driving circuit 70 is a control circuit that serves to supply a driving signal (pulse) to a tape conveying motor 2 based on the control signal from the CPU 61 for controlling operation of the tape conveying motor 2.

Here will be described on the process to form each dot array on each printing line on the surface tape 31 by electrically energizing the thermal head 41, by referring to FIG. 4. A printing line is a line on which an array of dots is formed in a width direction of the surface tape 31 by electrically energizing an array of heater elements in a single printing cycle. More specifically, printing lines are provided at intervals obtained by dividing in a unit length in the conveying direction of the surface tape 31 by a numerical value corresponding to resolution.

A single printing cycle is time required to form an array of dots in the width direction of the surface tape 31. More specifically, a printing cycle consists of: "preheating 1" for supplementing heat capacity shortage of the thermal head at the start of printing; "preheating 2" for heating up temperature of heater elements to predetermined temperature (termed as ink-melting temperature, e.g., 90° C.) so as to allow target heater elements to carry out heat transfer printing (i.e., temperature hot enough to melt an ink layer of an ink ribbon); and "heating" for keeping temperature of the target heater elements at the ink-melting temperature.

It is to be noted that a printing cycle varies depending on resolution type and conveying speed of the surface tape 31. For instance, a printing cycle with resolution of 360 dpi and at printing speed of 40 mm/s is about 1.8 ms that is time required for the surface tape 31 to pass from a printing line a to a next printing line a (distance about 0.07 mm) at conveying speed of 40 mm/s. It is equal to a printing cycle with resolution of 180 dpi and at printing speed of 80 mm/s, that is to say, time required for the surface tape 31 to pass from a printing line b to a next printing line b (distance about 0.14 mm) at conveying speed of 80 mm/s. The printing lines b are showed in FIG. 4 as the same lines as every other lines of the printing lines a.

Therefore, for printing out an array of dots in the width direction of the surface tape 31, one printing line of line printing data created by the CPU 61 is transferred from the control unit 60 to the thermal head 41, through the head driving circuit 68 as the control signal and the drive signal above mentioned. In accordance with the thus transferred one printing line of line printing data, target heater elements are electrically energized. One printing line of line printing data corresponds to printing data for forming an array of dots in the width direction of the surface tape 31 by electrically energizing the array of the heater elements in a single printing period.

Therefore, heater elements electrically energized according to the one printing line of line printing data, are heated up to the ink-melting temperature (e.g., 90° C.) that is hot enough to melt ink of an ink layer. Consequently, of the ink layer on the ink ribbon 33, a part of the ink in contact with the thermal head 41 melts due to heat of the thermal head 41. Thereafter, melted ink in the ink layer is adhered onto the surface tape 31. Subsequently, by separating the ink ribbon 33 from the surface tape 31, only the adhered ink is transferred onto the surface tape 31 as one printing line of dots.

The surface tape 31 and the ink ribbon 33 are conveyed at predetermined conveying speed so as to repeatedly execute the above-described thermal transfer process line by line. In the printer 1, for conveying from a printing line a to a next printing line a (distance about 0.07 mm) with 360 dpi, two pulses are outputted to the tape conveying motor 2. Further, for conveying a printing line a to a next printing line a with 180 dpi (distance about 0.14 mm), four pulses are outputted to the tape conveying motor 2.

Significant number of heater elements aligned on the thermal head 41 are selectively and intermittently energized in accordance with line printing data of each printing line transferred from the control unit 60. Thereby, a dot image a user has desired is formed on the surface tape 31 in accordance with a letter string inputted with the letter input keys 31.

Figure 4:
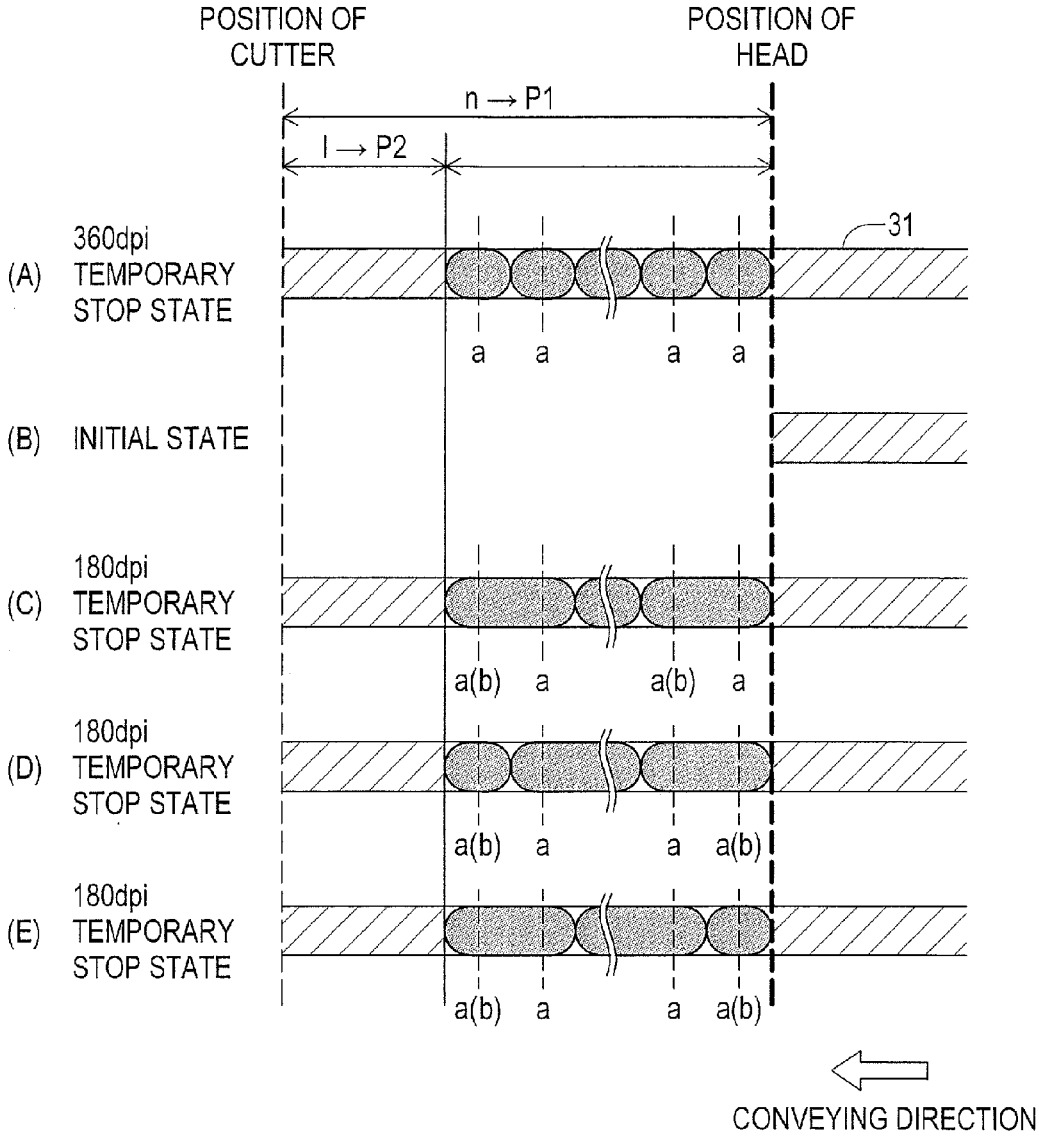
FIG. 4 shows exemplary printing patterns from start of printing till temporary stop of printing for cutting off a front margin with a printer directed to a first embodiment, wherein (A) indicates an exemplary printing with 360 dpi, (B) indicates an initial state and (C) (D) and (E) indicate exemplary printing with 180 dpi.

As indicated with (A) in FIG. 4, in the case where the resolution is set to 360 dpi, the surface tape 31 and the ink ribbon 33 are conveyed together through one printing line a in a state that heater elements corresponding to one printing line of line printing data for 360 dpi have been heated. Thereby, an array of dots (a single dot in FIG. 4) thermally transferred on the one printing line a is formed on the surface tape 31.

On the other hand, as indicated with (C) in FIG. 4, in the case where the resolution is set to 180 dpi, the surface tape 31 and the ink ribbon 33 are conveyed together through two printing lines a for in a state that heater elements corresponding to one printing line of line printing data for 180 dpi have been heated. Thereby, an array of dots (a single dot in FIG. 4) thermally transferred on the two printing lines a is formed on the surface 31. Consequently, length of a dot formed with the resolution of 180 dpi is as twice as that of a dot formed with the resolution of 360 dpi with reference to the conveying direction of the surface tape 31.

Regarding the cases of (D) and (E) indicated in FIG. 4, an array of "half dots" is formed on a single printing line a despite the situation that the resolution is set to 180 dpi for (D) and (E). In those cases, the half dots are formed by conveying the surface tape 31 and the ink ribbon 33 together through one printing line a in a state that heater elements corresponding to one printing line of line printing data for 180 dpi have been heated. A single printing cycle for forming an array of half dots is a half length of that of a single printing cycle taken for normal printing with 180 dpi, i.e., the same length as a single printing cycle with 360 dpi at conveying speed as fast as conveying speed for normal printing with 180 dpi. Consequently, a conveying directional length of a half dot created in a half dot process is the same as that of a dot created in printing with 360 dpi.

In fact, in the first embodiment, forming an array of "half dots" is equivalent to forming a portion of dot arrays with 360 dpi even when printing resolution is set to 180 dpi (similarly, in the second embodiment).

Next, there will be described on various processing programs for the printer 1 in detail by referring to FIG. 4 through FIG. 9. Firstly, a before-printing process directed to FIG. 5 will be described. It is to be noted that the programs illustrated with flowcharts directed to FIG. 5 through FIG. 9 are stored in the ROM 64 and executed by the CPU 61.

Figure 5:
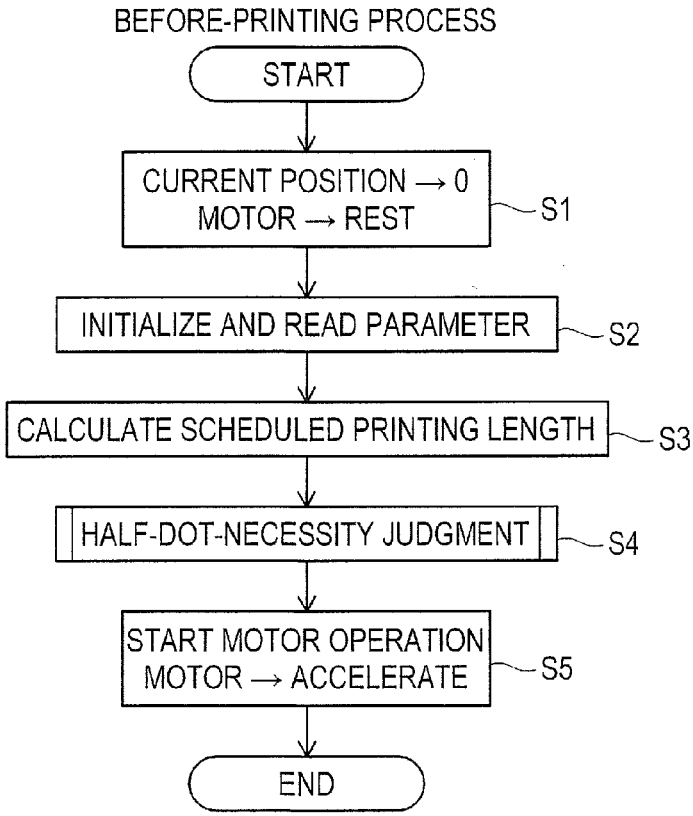
FIG. 5 is a flowchart of a before-printing process directed to the first embodiment.

The before-printing process shown in FIG. 5 is executed when the following conditions are satisfied: the power of the printer 1 is ON; the print key 3B of the key board 3 is depressed; and resolution currently set and stored in the EEPROM 63 is 180 dpi.

In FIG. 4, (B) indicates an initial state prior to the start of the before-printing process.

It is to be noted that the ROM 64 has previously calculated and stored the number of pulses P1 (refer to FIG. 4) to be outputted to the tape conveying motor 2 while the surface tape 31 is conveyed by distance n that is from the thermal head 41 to the cutter 17. Further, the ROM 64 has previously calculated and stored the number of pulses P2 (refer to FIG. 4) to be outputted while desired length l of a front margin is conveyed.

It is to be noted that the number of pulses obtained by subtracting P2 from P1 (P1−P2) is an integer divisible by 2. Given that a temporary-stop-scheduled position of printing on the surface tape 31 is defined as a position for the thermal head 41 to be at when the cutter 17 is at a position to make length of the front margin 1, the number of pulse signals expressed with (P1−P2) is equal to the number of pulses to be outputted to the tape conveying motor 2 while the surface tape 31 is conveyed from a printing-start position to the temporary-stop-scheduled position. As already described, 2 corresponds to the number of pulses to be outputted to the tape conveying motor 2 while the surface tape 31 conveyed from a printing line a to a next printing line a with 360 dpi. Accordingly, in the case where the number directed to (P1−P2) is an integer divisible by 2, as indicated at (A) in FIG. 4, when the cutter 17 is at the position to make length of the front margin "1", the thermal head 41 is positioned at a period of forming an array of dots. Therefore, the thermal head 41 can temporarily stop printing at the temporary-stop-scheduled position.

It is to be noted that a half dot mode determination flag for determining whether or not to execute a half dot process in a printing process has previously been set OFF and stored in the RAM 66.

When the before-printing process is started, the CPU 61 firstly sets a value of a current position to 0 and stops operation of the tape conveying motor 2 at step (abbreviated as S, hereinafter) 1. It is to be noted that, in the printer 1, a value of a current position means a relative position of the thermal head 41 on a printing medium. It is also noted that the value of the current position increases by 1 every pulse cycle of the tape conveying motor 2.

Next, at S2, the CPU 61 initializes and reads various parameters. That is, the CPU 61 deletes printing data stored in the RAM 66 and, thereafter, creates line printing data for specifying to-be- and not-to-be heated heater elements on the thermal head 41 for each printing line in accordance with an input signal from the key board 3 etc. Further, the CPU 61 reads out the number of pulses P1 and the number of pulses P2 from the ROM 64.

Next, at S3, the CPU 61 calculates a value of (P1−P2) and stores the subtraction result as scheduled printing length in the RAM 66.

Figure 6:
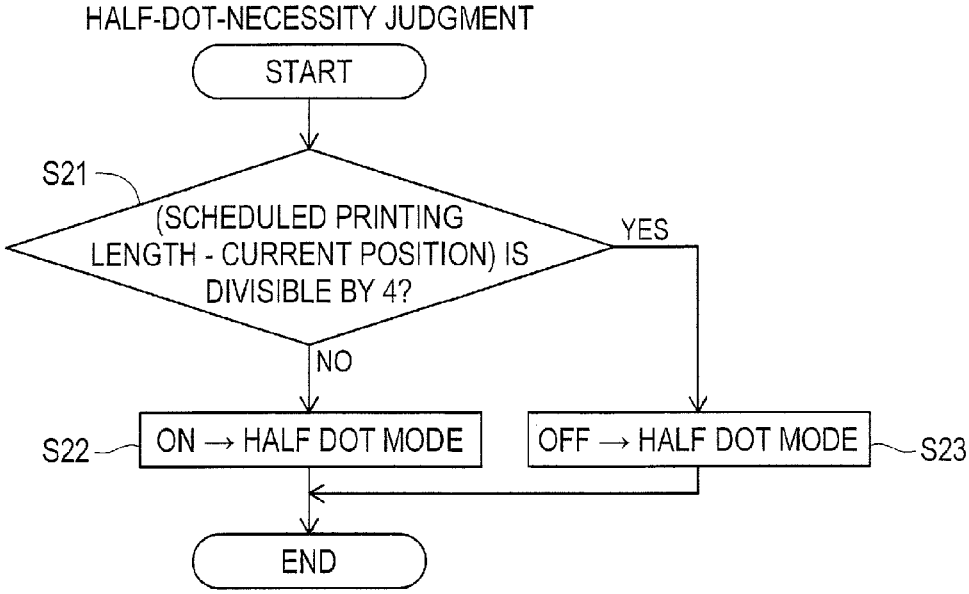
FIG. 6 is a flowchart of a half-dot-necessity judgment process directed to the first embodiment.

Next, the CPU 61 goes on to S4 for a half-dot-necessity judgment process. As shown in FIG. 6, the half-dot-necessity judgment process is to judge whether or not execute a half dot process during a period from start of next printing till temporary stop of printing for cutting off front margin. When the judgment process is started, the CPU 61 reads out (P1−P2) as the number of pulses stored as equivalence of scheduled printing length, from the RAM 66, at S21. More specifically, the CPU 61 calculates the number of pulses directed to (P1−P2−0), that is obtained by subtracting "current position 0" from (P1−P2), so as to find if it is divisible by 4. As already described, 4 is the number of pulses to be outputted to the tape conveying motor 2 for conveying from a printing line b to a next printing line b with 180 dpi.

A case that a value of (P1−P2−0) is divisible by 4 corresponds to a case that the above mentioned temporary-stop-scheduled position (position to make a current position value of the thermal head 41 P1) is at a period of forming an array of dots, i.e., a case that the thermal head 41 can temporarily stop printing at the temporary-stop-scheduled position when the cutter 17 is at a position to make length of a front margin 1, predetermined length. In other words, the number of dot-array-formed printing lines a from start of printing till temporary stop is equal to that in printing with 360 dpi.

On the other hand, a case that a value of (P1−P2−0) is not divisible by 4 corresponds to a case that the temporary-stop-scheduled position is at a half-done position for forming an array of dots, i.e., a case that the thermal head 41 cannot temporarily stop printing at the temporary-stop-scheduled position when the cutter 17 is at a position to make length of a front margin 1. In such a case, unless printing on an extra printing line a is allowed for completion of forming the half-done dot array or the temporary stop is made before forming an array of dots to be formed at the temporary-stop-scheduled position, temporary stop of printing cannot be done. Therefore, the number of dot-array-formed printing lines a from start of printing till temporary stop of printing turns to be different from dot-array-formed number of printing line a in printing with 360 dpi.

In case (P1–P2) is divisible by 4 (S21: YES), the CPU 61 keeps setting the half dot mode determination flag stored in the RAM 66 OFF. Accordingly, a half dot process is not executed in next printing. On the other hand, in case (P1–P2) is not divisible by 4 (S21: NO), the CPU 61 newly sets the half dot mode determination flag ON and stores it in the RAM 66. Accordingly, a half dot process is executed in next printing.

Figure 7:
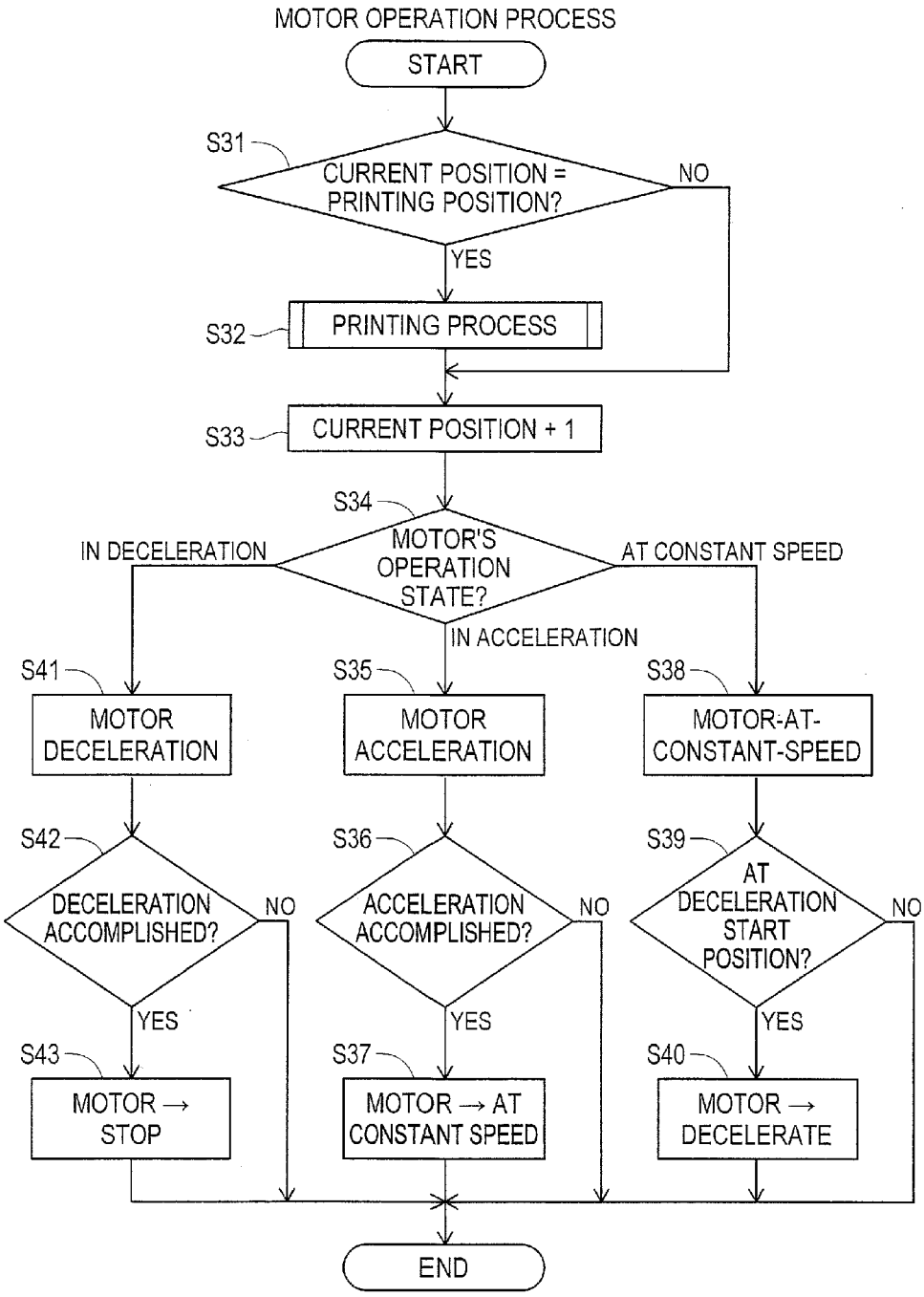
FIG. 7 is a flowchart of a motor operation process directed to the first embodiment.

After finishing the half-dot-necessity judgment process, the CPU 61 shifts the process to S5 (refer to FIG. 5) for a motor operation process so as to accelerate the tape conveying motor 2. The motor operation process to be described by referring to S31 through S43 in FIG. 7 is executed every operation pulse cycle of the tape conveying motor 2. Accordingly, interval between successive motor operation processes is made gradually shorter during acceleration of the motor, made constant during constant speed operation, and made gradually longer during deceleration of the motor.

As shown in FIG. 7, at S31 in the motor operation process, the CPU 61 firstly detects whether or not the current position of the thermal head 41 is at a printing position. The current position is not regarded as printing position as long as the number of pulses lowers P2. In case the current position is not at a printing position (S31: NO), the CPU 61 goes on to S33 so as to store in the RAM 66 the number equivalent to a sum of current position plus 1. After that, the CPU 61 shifts the process to S34.

At S34, the CPU 61 detects operation state of the tape conveying motor 2. In case an acceleration state is detected (S34: IN ACCELERATION), the CPU 61 goes on to S35 so as to execute a motor acceleration process at S35 wherein a next pulse is outputted to the tape-conveying-motor driving circuit 70 at proper timing to accelerate the tape conveying motor 2. After that, the CPU 61 shifts the process to S36 so as to confirm accomplishment of acceleration, i.e., confirm whether or not the tape conveying motor 2 has been accelerated. In case acceleration of the tape conveying motor 2 has been accomplished (S36: YES), the CPU 61 shifts the process to S37 wherein timing for a next pulse to be outputted to the tape-conveying-motor driving circuit 70 is decided to suppress acceleration for allowing the tape conveying motor 2 to rotate at constant speed. After that, the CPU 61 terminates the motor operation process. In case acceleration of the tape conveying motor 2 has not been accomplished (S36: NO), the CPU 61 terminates the motor operation process as it is.

In case an operation-at-constant-speed state is detected (S34: AT CONSTANT SPEED), the CPU 61 goes on to S38 to execute a motor-at-constant-speed process wherein a next pulse is outputted to the tape-conveying-motor driving circuit 70 at proper timing to continuously rotate the tape conveying motor 2 at the constant speed. After that, the CPU 61 shifts the process to S39 so as to detect whether or not a current position of the thermal head 41 is a deceleration start position. In case it is at the deceleration start position (S39: YES), the CPU 61 shifts the process to S40 wherein timing for a next pulse to be outputted to the tape-conveying-motor driving circuit 70 is decided to decelerate rotation of the tape conveying motor 2. After that, the CPU 61 terminates the motor operation process. In case it is not at the deceleration start position (S39: NO), the CPU 61 terminates the motor operation process as it is.

In case a deceleration state is detected at S34 (S34: IN DECELERATION), the CPU 61 goes on to S41 so as to execute a motor deceleration process at S35 wherein a next pulse is outputted to the tape-conveying-motor driving circuit 70 at proper timing to decelerate the tape conveying motor 2. After that, the CPU 61 shifts the process to S42 so as to confirm accomplishment of deceleration, i.e., confirm whether or not deceleration of the tape conveying motor 2 has been accomplished. In case deceleration of the tape conveying motor 2 has been accomplished (S42: YES), the CPU 61 shifts the process to S43 so as to stop rotation of the tape conveying motor 2 and thereafter, terminate the motor operation process. In case deceleration of the tape conveying motor 2 has not been accomplished (S42: NO), the CPU 61 terminates the motor operation process as it is.

Further, in case the number of pulses exceeds P2, the current position is regarded as printing position. In case the current position is at a printing position (S31: YES), there will be executed a printing process (S51 through S59) to be described with FIG. 8.

Figure 8:
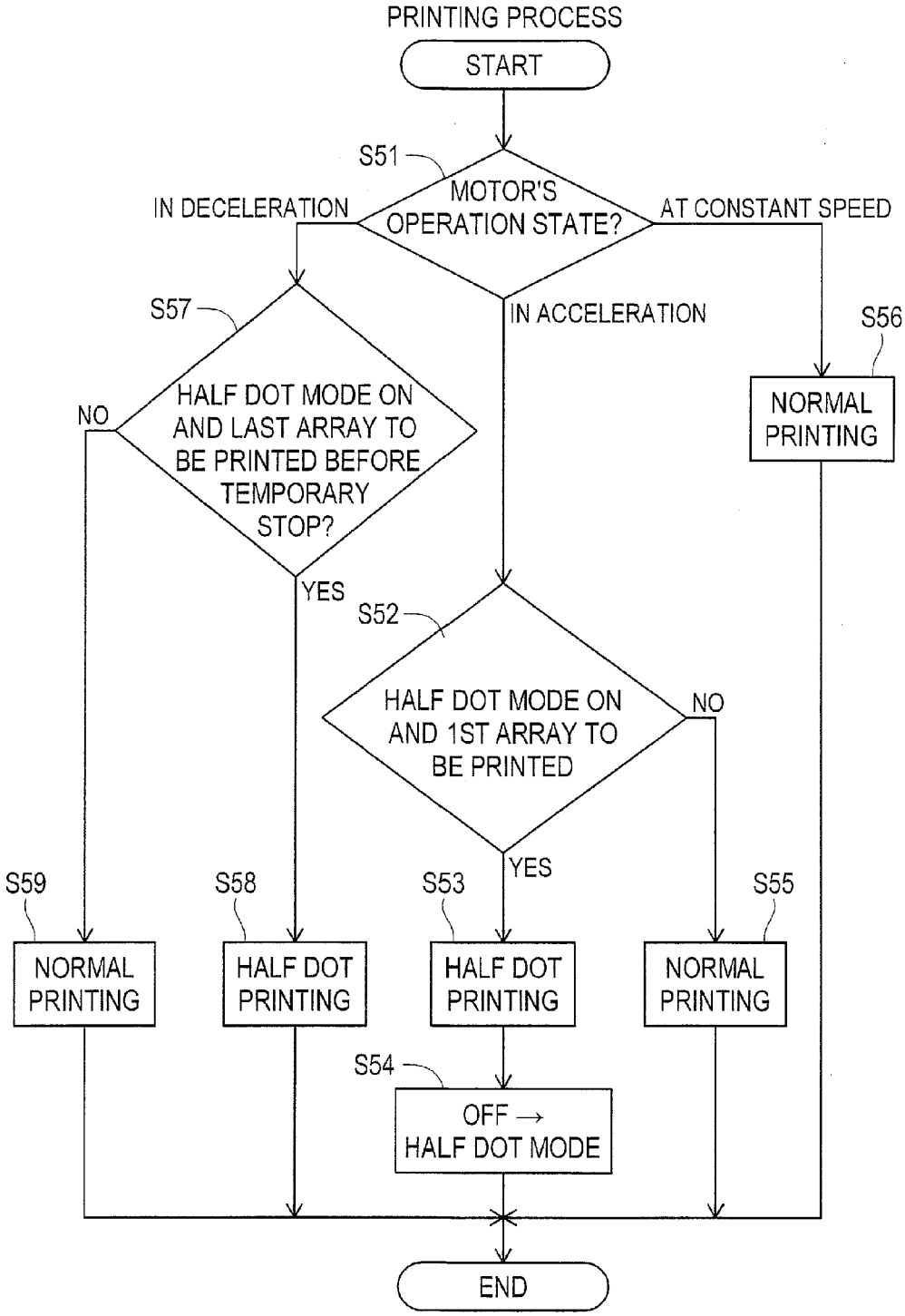
FIG. 8 is a flowchart of a printing process directed to the first embodiment.

The printing process will be described by referring to FIG. 8. As already described, the printing process is a part of the motor operation process. Accordingly, the printing process is executed every pulse cycle of the tape conveying motor 2.

In case the current position is at a printing position as already so conditioned (S31: YES), the CPU 61 detects operation state of the tape conveying motor 2 at S51. In case the tape conveying motor 2 is in an acceleration state (S51: IN ACCELERATION), the CPU 61 goes on to S52 so as to read out a half dot mode determination flag from the RAM 66 and detect whether or not the thus read half dot mode determination flag is ON and the thermal head 41 is about to print out dots of the first array for the beginning of printing operation. In case it is detected that the half dot mode determination flag is ON and dots of the first array are to be printed for the beginning of printing operation (S52: YES), the CPU 61 goes on to S53 so as to execute a half-dot printing process.

As already described, for the half dot printing, the CPU 61 conveys the surface tape 31 and the ink ribbon 33 together through one printing line a in a state that target heater elements directed to one printing line of line printing data for 180 dpi, read out from RAM 66 and transferred to the thermal head 41, are heated. For the conveyance through one printing line a, the tape conveying motor 2 conveys the surface tape 31 by two pulses. Therefore, the motor operation process including the printing process is repeated twice so as to make the thermal head 41 form an array of half dots. Thereby, an array of half dots is formed on one printing line a and length of the half dot is half of a normal dot to be printed with normal printing operation with 180 dpi.

After that, the CPU 61 goes on to S54 so as to newly set the half dot mode determination flag OFF and store it in the RAM 66. Thereby, the CPU 61 terminates the printing process and goes on to S33 (refer to FIG. 7).

In case the half dot mode determination flag is OFF or the thermal head 41 is not about to print out dots of the first array for the beginning of printing operation (S52: NO), the CPU 61 goes on to S55 for normal dot printing.

For the normal dot printing, the CPU 61 conveys the surface tape 31 and the ink ribbon 33 together through two printing lines a in a state that target heater elements of one printing line of line printing data for 180 dpi, readout from RAM 66 and transferred to the thermal head 41, are heated. For the conveyance through two printing lines a, the tape conveying motor 2 conveys the surface tape 31 by four pulses. Therefore, the motor operation process including the printing process is repeated four times for the thermal head 41 to form an array of normal dots. Thereby, a normal dot is formed so as to occupy two printing lines a.

Thereafter, the CPU 61 terminates the printing process and goes on to S33 (refer to FIG. 7).

On the other hand, in case it is detected that the tape conveying motor 2 rotates at constant speed at S51 (S51: AT CONSTANT SPEED), the CPU 61 goes on to S56 for normal dot printing. Thereafter, the CPU 61 terminates the printing process and goes on to S33 (refer to FIG. 7).

Further, in case it is detected that the tape conveying motor is decelerated at S51 (S51: IN DECELERATION), the CPU 61 reads out the half dot mode determination flag from the RAM 66 and detects whether or not the half dot mode determination flag is ON, the current position is (P1−1) and the thermal head 41 is about to print out dots of the last array to be formed before reaching a temporary-stop-scheduled position. In the first embodiment, temporary stop of conveying the surface tape 31 and temporary stop of printing by the thermal head 41 are executed almost at the same time. Therefore, S51 is a process for detecting whether or not the thermal head 41 is about to form dots of the last array to be formed immediately before the temporary stop of rotation of the tape conveying motor 2, in other words.

In case it is detected that the half dot mode determination flag is ON and the thermal head 41 is about to print out dots of the last array to be formed before reaching a temporary-stop-scheduled position, the CPU 61 goes on to S58 for half dot printing. Thereafter, the CPU 61 terminates the printing process and goes on to S33 (refer to FIG. 7).

On the other hand, in case it is detected that the half dot mode determination flag is OFF or the thermal head 41 is not about to print out dots of the last array to be formed before reaching a temporary-stop-scheduled position, the CPU 61 goes on to S59 for normal dot printing. Thereafter, the CPU 61 terminates the printing process and goes on to S33 (refer to FIG. 7)

Next, there will be described on a motor stopping process to be executed when the tape conveying motor 2 stops rotation at S43 in the motor operation process (refer to FIG. 7), by referring to FIG. 9.

Figure 9:
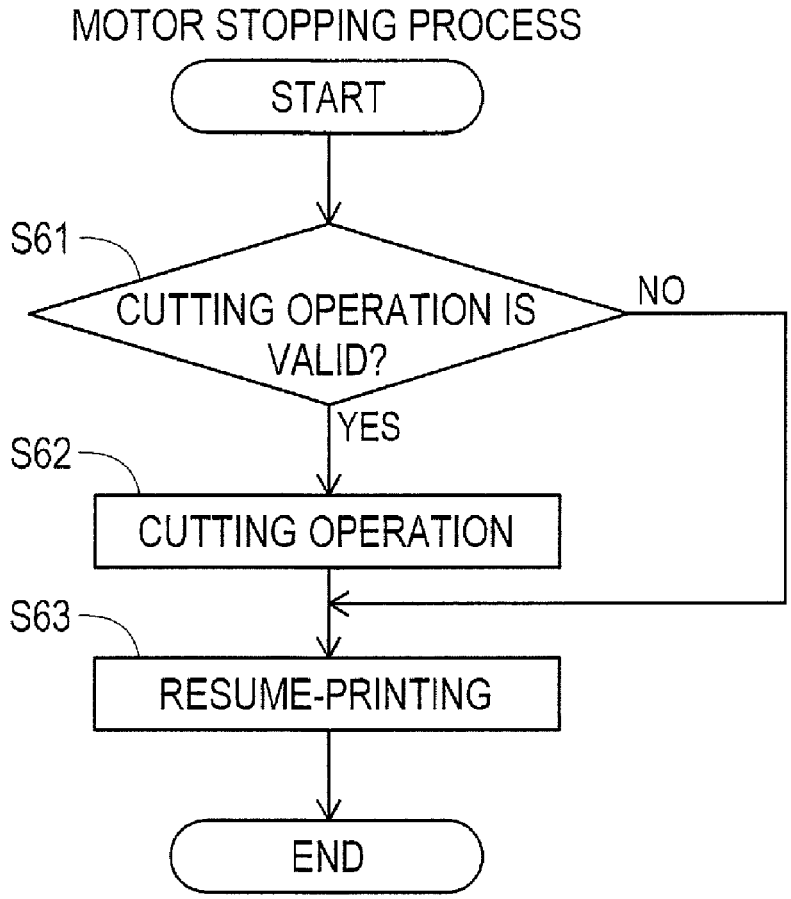
FIG. 9 is a flowchart of a motor stopping process directed to the first embodiment.

As shown in FIG. 9, when the tape conveying motor 2 stops rotation, the CPU 61 checks operation state of the tape cutting motor 72 so as to detect whether or not cutting operation is valid at S61. In case it is detected that the cutting operation is valid (S61: YES), the CPU 61 goes on to S62 so as to transmit a drive signal to the tape-cutting-motor driving circuit 69. Consequently, the tape cutting motor 72 is driven and the laminated tape 38 is cut off for its front margin by the fixed blade 17*a* and the rotary blade 17.

On the other hand, in case it is detected that the cutting operation is not valid (S61: NO), the CPU 61 resumes printing as it is without cutting off the laminated tape 38 for a front margin.

To sum up, after executing the half-dot-necessity judgment process (refer to FIG. 6) described in the before-printing process, the CPU 61 executes a motor operation process for every pulse cycle of the tape conveying motor 2. Until the value of the current position reaches P2 from 0, the surface tape 31 is conveyed by repeating a motor operation process without a printing process. Once the value of the current position exceeds P2, printing operation is started and a motor operation with a printing process is repeated until the value of the current position reaches P1. During printing operation, motor operation is gradually changed from acceleration, operation at constant speed and to deceleration, and then conveyance of the surface tape 31 is stopped for cutting off a front margin. Almost synchronously with the temporary stop of conveyance of the surface tape 31, printing is stopped temporarily and the cutter 17 cuts off the surface tape 31 for its front margin.

In case it is detected that (P1−P2−0) is divisible by 4 (S21: YES) in the half-dot-necessity judgment process, all the dot arrays to be printed from start of printing till temporary stop of printing are formed in the form of normal dot. In this case, printing of the last array of dots can be finished exactly at the temporary-stop-scheduled position that makes the current position P1 so that the thermal head 41 can temporarily stop printing at the exactly-scheduled position. Accordingly, the number of dot-array-formed printing lines a from start of printing till temporary stop of printing for 360 dpi is equal to that of dot-array-formed printing lines a in printing with 360 dpi, whereby length of the front margin cut off by the cutter 17 is made length l.

On the other hand, as indicated with (D) in FIG. 4, in case it is detected that (P1−P2−0) is not divisible by 4 (S21: NO) and the tape conveying motor 2 is accelerated (S51: IN ACCELERATION) when the value of the current position is (P2+1), dots of the first array for the beginning of the printing operation are formed in a form of half dot. After printing of the first array, the half dot mode determination flag is newly set OFF (S54). Therefore, normal dots are formed continuously until temporary stop of printing. In this case, printing of the last array of dots can be finished exactly at the temporary-stop-scheduled position that makes the current position P1 so that the thermal head 41 can temporarily stop printing at the exactly-scheduled position. Accordingly, the number of dot-array-formed printing lines a used for forming dots from start of printing till temporary stop of printing for 360 dpi is equal to dot-array-formed printing lines a in printing with 360 dpi, whereby length of the front margin cut off by the cutter 17 is made length l.

Further, as indicated with (E) in FIG. 4, in case it is detected that (P1−P2−0) is not divisible by 4 (S21: NO) and the tape conveying motor 2 is rotated at constant speed or decelerated (S51: AT CONSTANT SPEED or IN DECELERATION) when the value of the current position is (P2+1), dots of the first array for the beginning of the printing operation are not formed in a form of half dot and printing operation is continued with the half dot mode remaining ON. Therefore, dots of the last array to be formed when the value of the current position is (P1−1) are formed in a form of half dot. In this case as well, printing of the last array of dots can be finished exactly at the temporary-stop-scheduled position that makes the current position P1 so that the thermal head 41 can temporarily stop printing at the exactly-scheduled position. Accordingly, the number of dot-array-formed printing lines a from start of printing till temporary stop of printing for 360 dpi is equal to dot-array-formed printing lines a in printing with 360 dpi, whereby length of the front margin cut off by the cutter 17 is made length l.

Next, there will be described on a printer directed to a second embodiment. As to constituent elements exactly or substantially identical with those of the printer 1 directed to the first embodiment, numerals or signs identical with those in the first embodiment are assigned in the second embodiment and descriptions on the identical constituent elements will be omitted.

Figure 10:
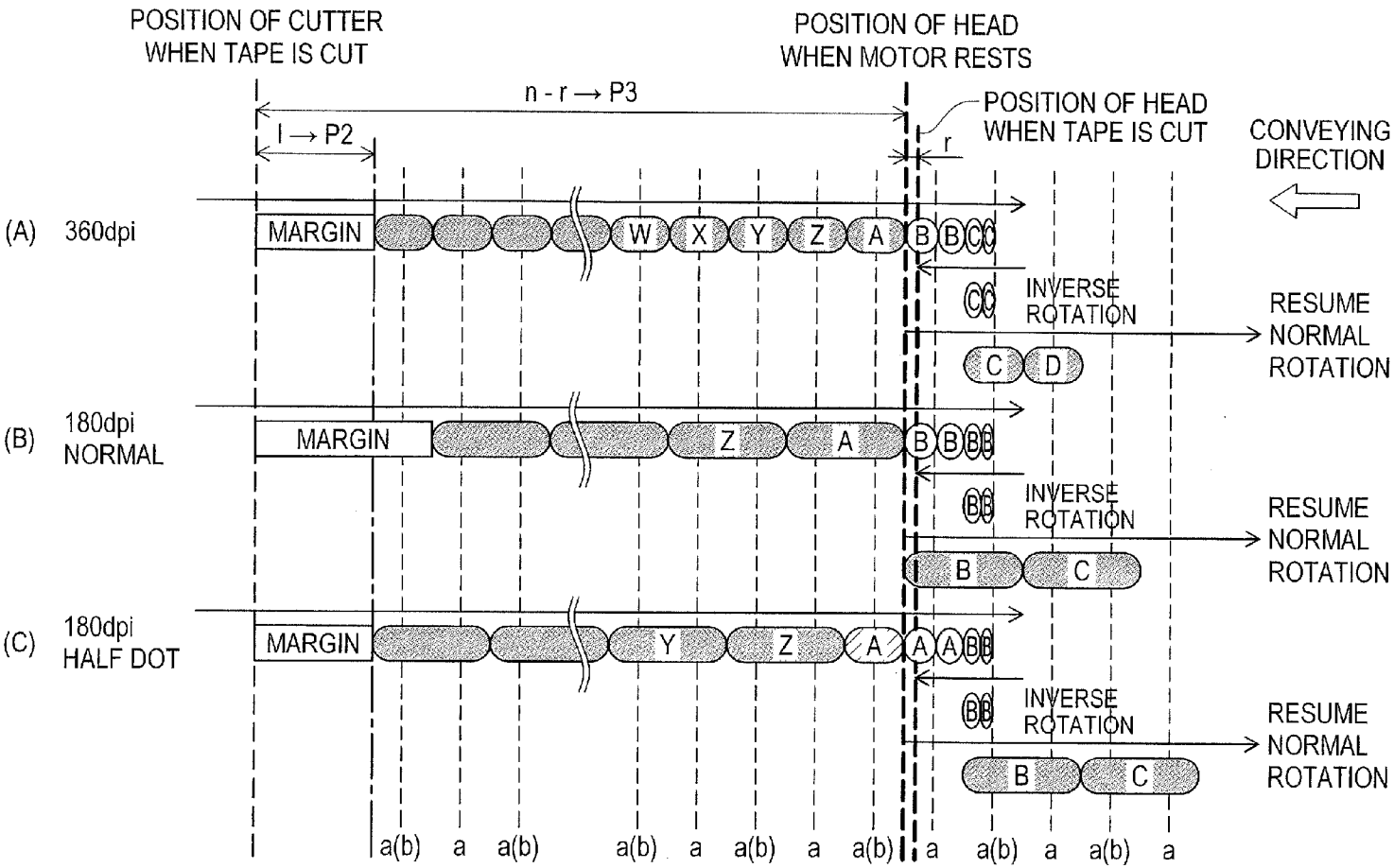
FIG. 10 shows exemplary printing patterns from start of printing to resuming of printing after temporary stop of printing with a printer directed to a second embodiment, wherein (A) indicates an exemplary printing with 360 dpi, and both (B) and (C) indicate exemplary printing with 180 dpi.

FIG. 10 shows exemplary printing patterns formed by the printer directed to the second embodiment. In FIG. 10, (A) indicates a case that printing is executed with 360 dpi (abbreviated as 360 dpi printing mode, hereinafter) and (C) indicates a case that the last array of dots to be formed immediately before temporary stop of the tape conveying motor 2 with 360 dpi under 180 dpi printing mode (abbreviated as 180 dpi half dot printing mode, hereinafter).

Further, (B) in FIG. 4 indicates a comparative example wherein length of a front margin of (B) differs from that of 360 dpi printing mode since the time point to stop normal rotation of the tape conveying motor 2 is made ahead by half length in the conveying direction of a normal 180-dpi dot in comparison with the 360 dpi printing mode without executing half dot printing.

The alphabets assigned to respective dot indicate the order of line printing data for printing dots.

In the printer directed to the second embodiment, the tape conveying motor 2 is capable of normal rotation and inverse rotation, and inversely rotates in response to temporary stop of printing. As shown in FIG. 10, three rows of dot arrays (dot arrays, actually) vertically arranged are shown in each printing mode of (A) through (C), each row consisting of dots (dot arrays, actually) arranged in the conveying direction. A row at each top stage in (A) through (C) shows a row of dot arrays formed along normal rotation and rest of the tape conveying motor 2 from start of printing to stop of its normal rotation. A row at each middle stage in (A) through (C) shows a row of dot arrays formed during inverse rotation of the tape conveying motor 2. A row at each bottom stage in (A) through (C) shows a row of dot arrays formed after the tape conveying motor 2 resumes normal rotation. Horizontal arrows above respective staged rows in (A) through (C) indicate printing directions of the respective staged rows. Those three rows are printed at the same position with reference to the width direction of the surface tape 31. Therefore, three rows printed are seen as a single row of dot arrays, actually.

As shown in FIG. 10, when the tape conveying motor 2 resumes normal rotation, printing is resumed so as to overlap on at least last one of dot arrays formed before the resuming of the normal rotation.

In the second embodiment, a front margin is cut off when inverse rotation of the tape conveying motor 2 is stopped, which will be described in detail later. A time point of temporary stop of printing means a time point to finish forming the last dot array to be formed before the inverse rotation is stopped.

In FIG. 10, a half dot under 180 dpi printing mode is shaded with diagonal lines whereas what are shaded with gray tone are dots to be formed before the tape conveying motor 2 stops normal rotation temporarily and dots to be formed after the tape conveying motor 2 resumes normal rotation. That is, the dots shaded with gray tone and the half dot shaded with diagonal lines are dots to be formed during normal rotation of the tape conveying motor 2, similar to dots to be formed as so in the first embodiment.

In the second embodiment, dot arrays are formed even when the tape conveying motor 2 stops normal rotation. Although formation of dot arrays during rest of normal rotation is done through inertia, those dot arrays are formed at predetermined timing, as will be described later. It is to be noted that the "predetermined timing" means time for printing out dot arrays to be formed at the predetermined moments, i.e., printing cycles for printing out the dot arrays, are previously determined, as well. Further, even during inverse rotation of the tape conveying motor 2, dots are formed at timing that a predetermined inverse rotation pulse is outputted. In FIG. 10, dot arrays to be formed during rest or inverse rotation are indicated as dots in white. It is to be noted that size and position of dot arrays to be formed during rest or inverse rotation of the tape conveying motor 2 are not determined depending on resolution.

It is similar with the first embodiment that the before-printing process in FIG. 5 and the half-dot-necessity judgment process in FIG. 6 are also executed in the second embodiment. However, the second embodiment includes below-described differences.

In the first embodiment, a front margin is simply cut off when tape conveyance operation is stopped. Accordingly, the half-dot-necessity judgment is made based on a value of (P1−P2), wherein P1 is the number of pulses to be outputted to the tape conveying motor 2 for conveying by distance n that is between the thermal head 41 and the cutter 17 and P2 is the number of pulses to be outputted to the tape conveying motor 2 for conveying by length l that is desired length of the front margin.

On the other hand, what is taken into consideration in the second embodiment is sliding distance r of the surface tape 31 during time from stop of normal rotation of the motor till cut of a front margin. For instance, as shown in FIG. 10, in the case where the position of the thermal head 41 when a front margin is cut off slides slightly from the position of the thermal head 41 when the motor stops normal rotation by distance r in the direction reverse to the tape conveying direction, half-dot-necessity judgment is made based on a criterion whether or not a value of (P3−P2) is divisible by 4 by using P3. It is to be noted that P3 is the number of pulses to be outputted for conveying by distance (n·r) wherein n is the distance between the thermal head 41 and the cutter 17. Here, it is given that the value of (P3−P2) is divisible by 2 and, as indicated at (A) in FIG. 10, the thermal head 41 is positioned at a period of forming an array of dots when the tape conveying motor 2 stops normal rotation under 360 dpi printing mode.

In case the position of the head when the tape is cut slides by distance r in the conveying direction from the position of the head when the motor rests normal rotation, P3 is interpreted as the number of pulses for conveying by distance (n+r).

A case that (P3−P2) is divisible by 4 means a case that the thermal head 41 is positioned at a period of forming an array of dots when the tape conveying motor 2 stops normal rotation. This means the number of dot-array-formed printing lines a in printing from start of printing till stop of normal rotation of the tape conveying motor 2 is equal to that of dot-array-formed printing lines a under 360 dpi printing mode.

Further, as already described, size and position of dot arrays to be formed through inertia during rest or inverse rotation of the tape conveying motor 2 are not determined depending on resolution. Therefore, the number of dot-array-formed printing lines a from stop of normal rotation of the tape conveying motor 2 till temporary stop of printing are the same regardless of resolution type difference. Accordingly, in case the number of dot-array-formed printing lines a from start of printing till stop of normal rotation is equal to that of dot-array-formed printing lines a in printing under 360 dpi printing mode, the number of dot-array-formed printing lines a from start of printing till temporary stop of printing is equal to that of dot-array-formed printing lines a in printing under 360 dpi printing mode.

On the other hand, a case that (P3−P2) is not divisible by 4 means a case that the thermal head 41 is at a half-done position for forming an array of dots when the tape conveying motor 2 stops normal rotation. In this case, for forming dots at timing the same as the case of 360 dpi printing mode during a stop of normal rotation of the tape conveying motor 2, the timing to stop normal rotation of the tape conveying motor 2 has to be shifted by a conveying direction length of a half dot in comparison with the case of 360 dpi printing mode. Consequently, the number of dot-array-formed printing lines a from start of printing till stop of normal rotation of the tape conveying motor 2 cannot be made equal to that of dot-array-formed printing lines a for printing under 360 dpi printing mode (refer to (B) in FIG. 10). Therefore, in the case, the number of dot-array-formed printing lines a from start of printing till temporary stop of printing cannot be equal to that of dot-array-formed printing lines a in printing under 360 dpi printing mode.

Therefore, in the second embodiment, the process is shifted to S23 in case (P3−P2) is detected to be divisible by 4 at S21 in the half-dot-necessity judgment (FIG. 6) and shifted to S22 in case (P3−P2) is detected to be not divisible by 4 at S21.

Next, there will be described on the motor operation process directed to the second embodiment by referring to FIG. 11.

Figure 11:
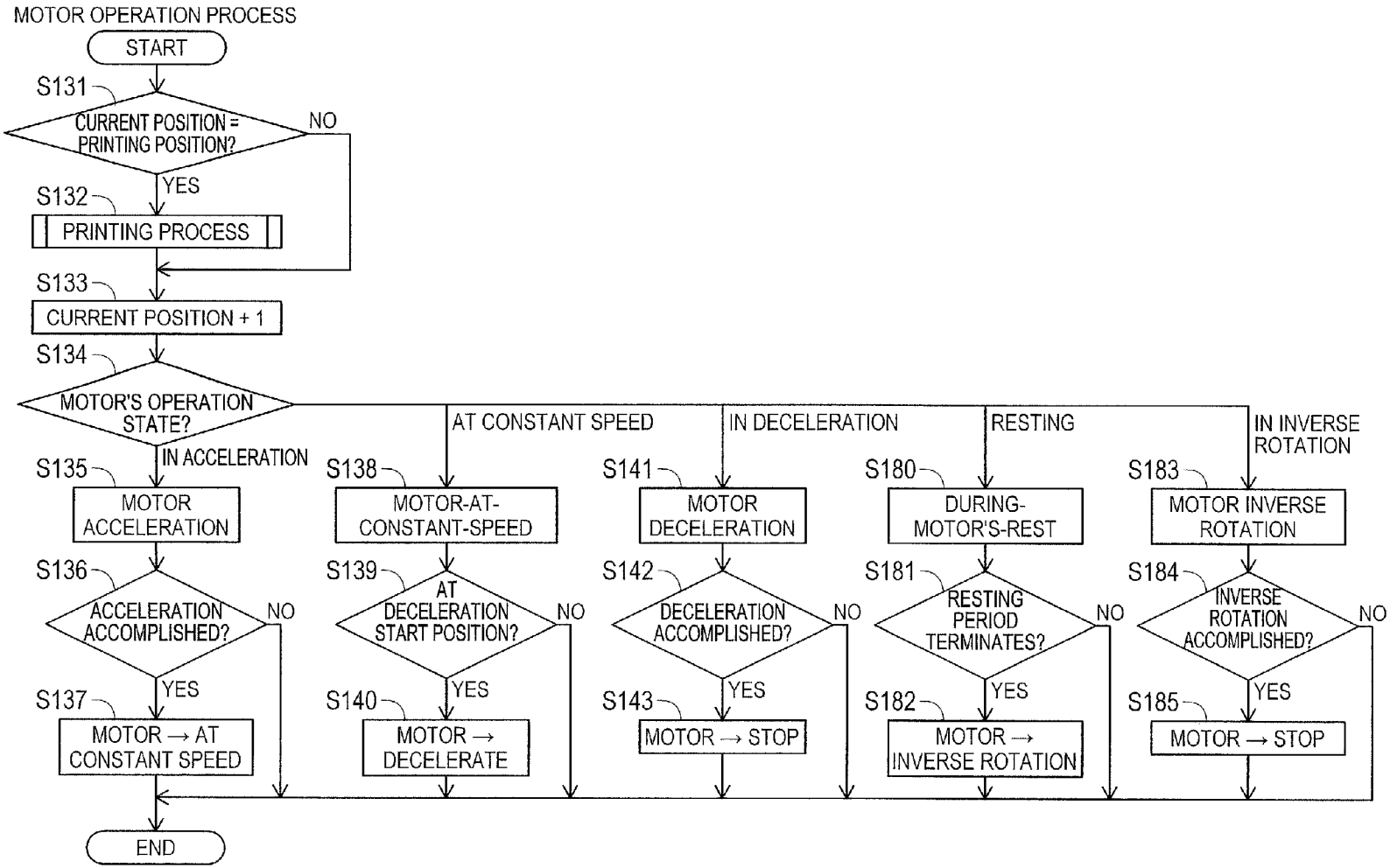
FIG. 11 is a flowchart of a motor operation process directed to the second embodiment.

As shown in FIG. 11, the motor operation process directed to the second embodiment is what a during-motor's-rest process (S180 through S182) and a motor inverse rotation process (S183 through S185) are added to the motor operation process for the first embodiment (refer to FIG. 7), wherein the during-motor's-rest process is to be executed while the tape conveying motor 2 rests and the motor inverse rotation process is to be executed while the tape conveying motor 2 is in inverse rotation. Accordingly, other steps, namely, S131 through S143 are almost the same as the steps S31 through S43 in the motor operation process directed to the first embodiment.

As shown in FIG. 11, in case the motor deceleration process is executed at S141 and accomplishment of the deceleration is confirmed at S142, the process is shifted to S143 and the tape conveying motor 2 rests.

As already described, the motor operation process directed to the first embodiment (refer to FIG. 7) is executed every operation pulse cycle.

A motor operation process during rest of the tape conveying motor 2, however, is started at predetermined timing. In case it is detected that the start of the motor operation process is at predetermined printing timing (S131: YES), the process is shifted to the printing process at S132 and further shifted to S133. In case it is detected that the start of the motor operation process is not at predetermined printing timing (S131: NO), the process is shifted to S133.

In case the tape conveying motor 2 rests, the process is shifted to S134 without changing the value of the current position at S133. At S134, motor's operation state is detected as resting state and the process is shifted to S180. At S180, the resting state of the tape conveying motor 2 is confirmed and the process is shifted to S181. At S181, it is detected whether or not timing to terminate the resting period of the tape conveying motor 2 comes. In case it is detected as not timing to terminate the resting period (S181: NO), the motor operation is terminated and the process is returned to S131 again at predetermined timing. In case it is detected as timing to terminate the resting period (S181: YES), the process is shifted to S182 so as to terminate the motor operation process by deciding timing of outputting an inverse rotation pulse for conveying the surface tape 31 in the direction reverse to the conveying direction and thereafter, the process is returned to S131 again at the timing to output the inverse rotation pulse.

Once the timing comes to output the inverse rotation pulse to the tape conveying motor 2, processes to follow S131 are repeated every reverse rotation pulse cycle. At S134, motor's operation state is detected as inverse rotation (S134: IN INVERSE ROTATION) and the process shifted to S183. At S183, the inverse pulse is outputted at the timing to the tape conveying motor 2. Thereafter, at S184, it is detected whether or not timing to terminate inverse rotation comes. In case it is detected as timing to terminate the inverse rotation (S184: YES), the process is shifted to S185 so as to make the tape conveying motor 2 rest again.

Next, there will be described on the printing process directed to the second embodiment by referring to FIG. 12. In the printing process directed to the second embodiment, processes S151 through S158 are almost the same as S51 through S59 in the printing process directed to the first embodiment (refer to FIG. 8), other than a during-rest printing process (S186) to be executed while the tape conveying motor 2 rests and a during-inverse-rotation printing process (S187) to be executed while the tape conveying motor 2 inversely rotates. However, different from processes S52 through S54 in the printing process directed to the first embodiment (refer to FIG. 8), in the printing process directed to the second embodiment, there is not executed a printing process to print out dots of the first array for the beginning of printing in a form of half dot. In the second embodiment, half dots are formed when the dots are the last array dots to be formed immediately before stop of normal rotation of the tape conveying motor 2 and the half dot mode determination flag is ON(S157: YES), where motor's operation state is detected as deceleration state (S151: IN DECELERATION).

Accordingly, in case that (P3−P2) is not divisible by 4 under 180 dpi printing mode, i.e., in case the number of dot-array-formed printing lines a from start of printing till temporary stop of printing is not equal to that of dot-array-formed printing lines a in printing under 360 dpi printing mode (S157: YES), the process is shifted to S158. Thereby, among dot arrays to be formed from start of printing till rest of normal rotation of the tape conveying motor 2, dots of the last array is formed in a form of half dot and dots of other arrays, ahead of the last array, are formed in a form of normal dot (refer to (C) in FIG. 10).

Figure 12:
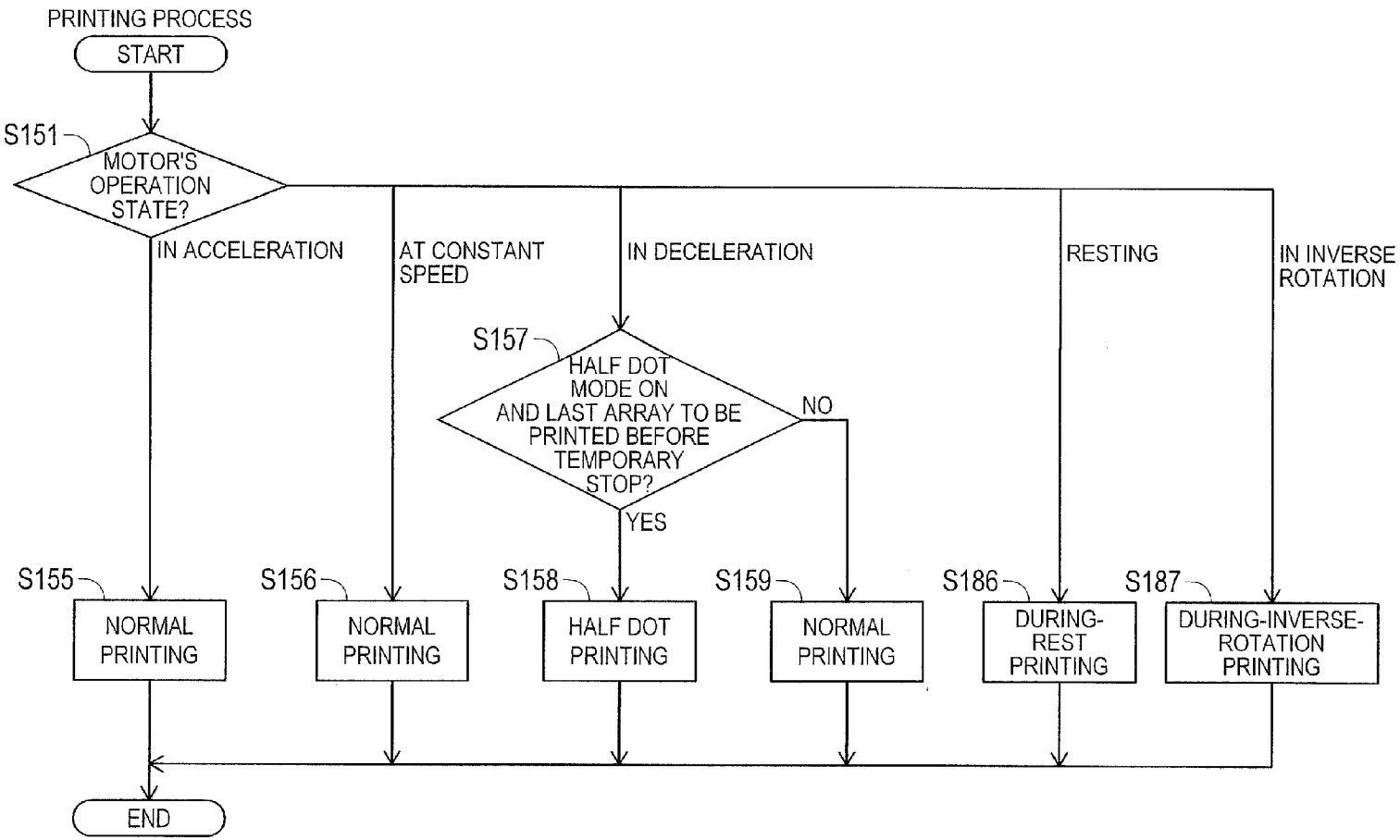
FIG. 12 is a flowchart of a printing process directed to the second embodiment.

As shown in FIG. 12, in case the printing process (S132) is executed at predetermined timing during stop of the tape conveying motor 2, the process is shifted from S151 to S186. In the during-rest printing process at S186, a single array of dots is formed in the printing direction.

Further, in case the printing process (S132) is executed when the predetermined inverse rotation pulse is outputted in the motor operation process, the process is shifted from S151 to S187. In the during-inverse-rotation printing process at S187, a single array of dots is formed in the printing direction.

There will be later described on the during-rest printing process at S186 and the during-inverse-rotation printing process at S187.

Next, there will be described on the motor stopping process directed to the second embodiment by referring to FIG. 13. In motor stopping process directed to the second embodiment, the tape conveying motor 2 stops normal rotation and subsequently starts inverse rotation (S160). When the inverse rotation is stopped, electrical energy supply to the tape conveying motor 2 is stopped. When the energy supply is stopped, detection on whether or not cutting operation is valid (S161) and a cutting operation (S162) are executed so as to cut off the front margin. It is to be noted that the laminated tape 38 is cut at the time of the inverse rotation is stopped so that movement amount of the laminated tape 38 when being cut can be minimized. After that, electrical energy is supplied to the tape conveying motor 2 again for normal rotation, whereby a resume-printing process is executed at S163.

Subsequently, the motor acceleration process (S135) is started in the motor operation process (FIG. 11) and the normal dot printing process (S155) is executed in the printing process (FIG. 12).

There will be described on forming dot arrays in the during-rest printing process, the during-inverse-rotation printing process and the resume-printing process by referring to FIG. 10.

Figure 13:
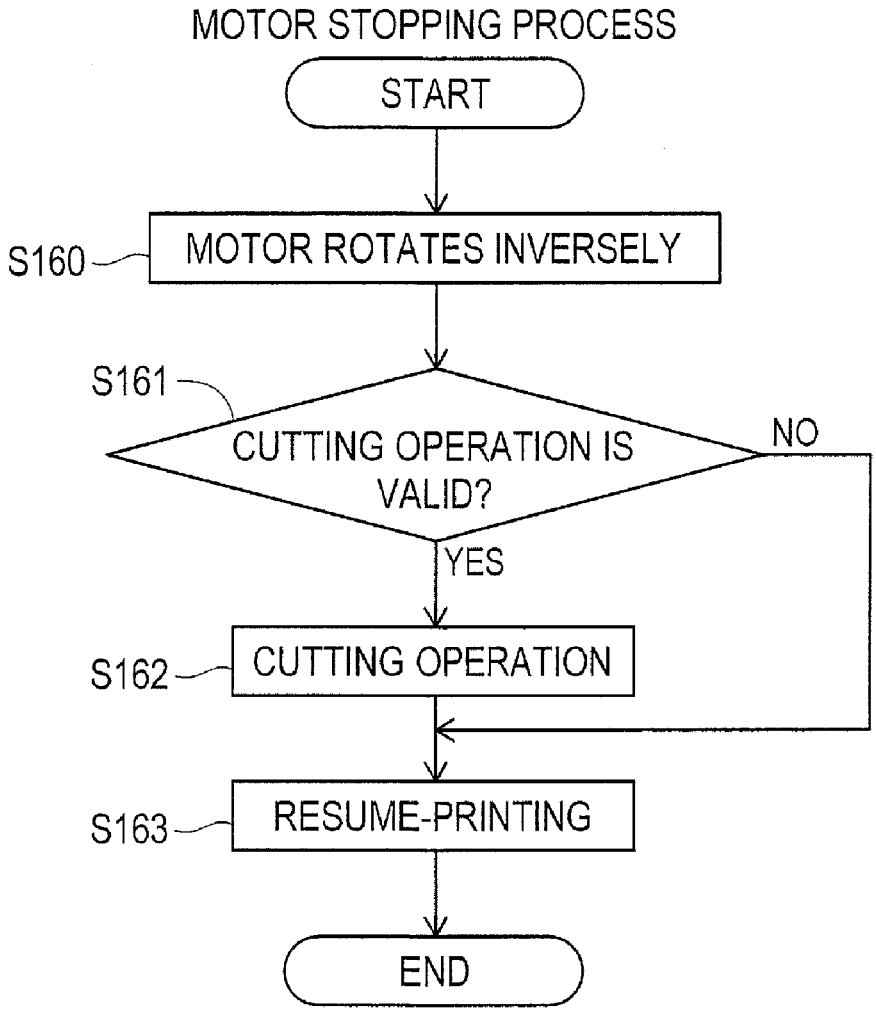
FIG. 13 is a flowchart of a during-motor's-stop process directed to the second embodiment.
Figure 14:
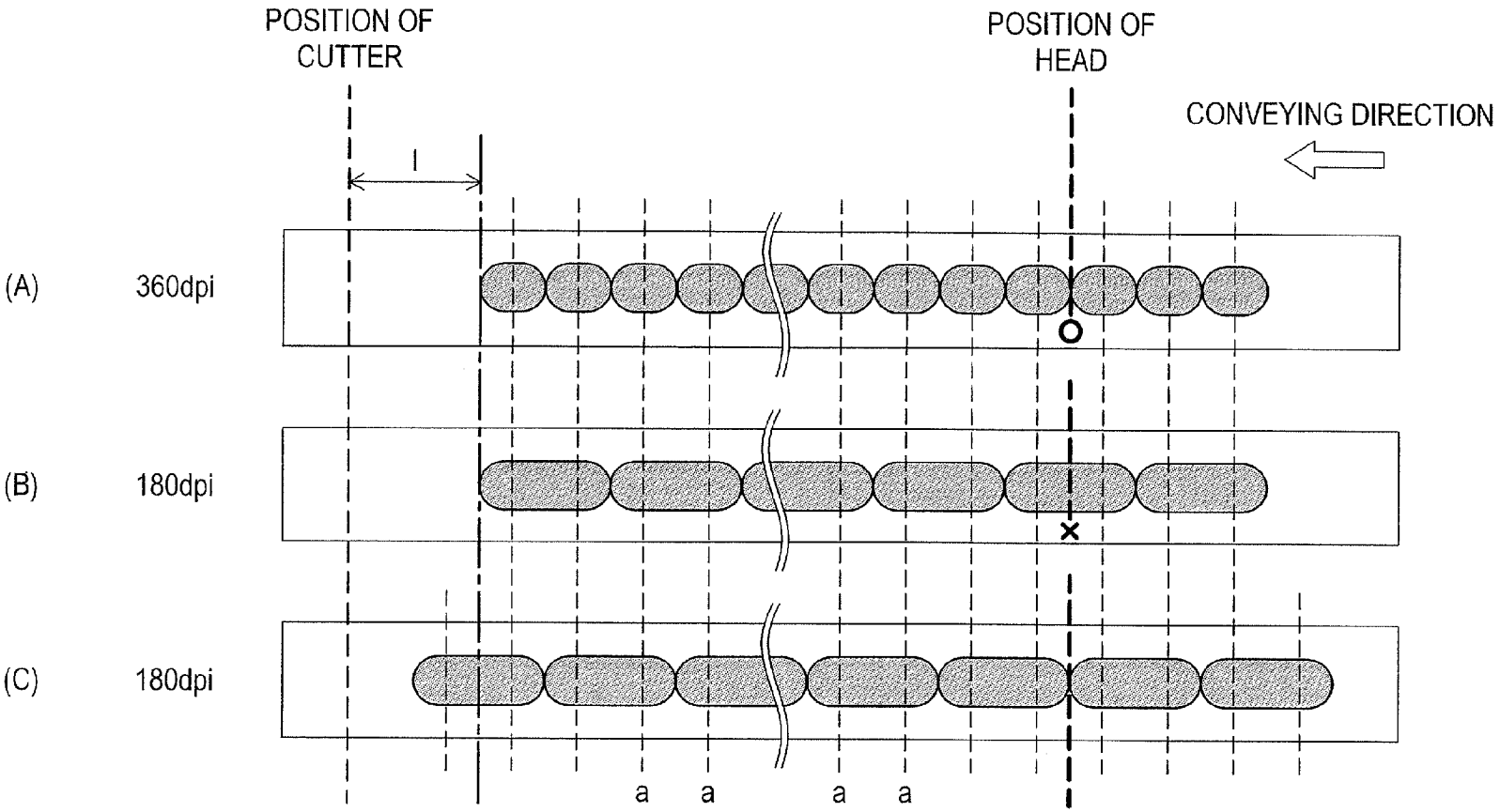
FIG. 14 PRIOR ART
FIG. 14 exemplary printing patterns from start of printing till temporary stop of printing for cutting off a front margin with a conventional printer, wherein (A) indicates an exemplary printing with 360 dpi and both (B) and (C) indicate printing with 180 dpi.

It is to be noted that respective processes described with FIG. 11 through FIG. 13 are executed within the scope of assumption that an array of half dots is formed immediately before the tape conveying motor 2 stops normal rotation under 180 dpi printing mode, i.e., formation of an array of half dots in the manner of (C) in FIG. 10. Among those processes, the during-rest printing process, the during-inverse-rotation printing process and the resume-printing process (refer to FIG. 12) are executed for both a printing operation under 360 dpi printing mode and a without-half-dot-formation printing operation under 180 dpi. Therefore, description will be given by referring to (A) through (C) in FIG. 10.

In common with (A) through (C) in FIG. 10, after the tape conveying motor 2 stops normal rotation, arrays of dots are formed at the same timing and time length of printing cycle during a resting state and inverse rotation of the tape conveying motor 2. As already described, at the case of (B) in FIG. 10, so as to form arrays of dots at timing the same as the timing under 360 dpi printing mode after the tape conveying motor 2 stops normal rotation, the timing to stop normal rotation of the tape conveying motor 2 is made ahead by a a half-dot length in the conveying direction.

Dots to be formed through the during-rest printing process (refer to FIG. 12) are indicated as four white dots (dot arrays, actually) aligned in the printing direction behind a dot (an dot array, actually) printed in accordance with line printing data A at respective exemplary printing patterns in FIG. 10.

"What line printing data is printed in forming each array of white dots" is determined depending on "which line printing data's scheduled printing region each of the arrays is to be formed on". A scheduled printing region means a region that is supposed to be printed out one printing line of line printing data (a line printing data) in a form of an array of normal dots with original resolution in case the tape conveying motor 2 keeps normal rotation for printing on the region without temporary stop of printing. To be more specific, the scheduled printing region may be a region from an end of the dot array at the side of the tape conveying direction to an end of the dot array at the side the direction reverse to the tape conveying direction. Timing to form dot arrays is controlled so that each dot array should not stick out of the scheduled printing region assigned to the target line printing data. Similar timing control is carried out at the during-inverse-rotation printing process (refer to FIG. 12).

For instance, in case of the (A) in FIG. 10, i.e., in case of 360 dpi printing mode, two successive dot arrays (indicated as two successive white dots in FIG. 10) printed with line printing data C are printed within a scheduled printing region where an array of normal dots supposed to be formed with the line printing data C under 360 dpi printing mode in case printing is continued without temporary stop. Here in this case, the array of normal dots corresponds to an array of normal dots to be formed under 360 dpi printing mode on the second one of printing line a counted from the printing line a for the line printing data A in the direction reverse to the conveying direction.

Further, among dot arrays to be formed during the tape conveying motor 2 rests, one or more arrays of dots that is not overlapped on arrays of dots to be formed after the tape conveying motor 2 resumes normal rotation are formed with controlled timing so as to make the regional width for printing out line printing data of the not-to-be-overlapped dot arrays approximate to the scheduled printing regional width that is supposed to be occupied in case the tape conveying motor 2 keeps normal rotation for printing without temporary stop. In case of (A) in FIG. 10, for instance, a sum of conveying directional width of two dot arrays (two dots in FIG. 10) to be printed as line printing data B is made to approximate to conveying directional width for one array of normal dots under 360 dpi printing mode.

Further, in the case where an array of half dots is formed immediately before the tape conveying motor 2 stops normal rotation as indicated at (C) in FIG. 10, one or more arrays of dots to be formed immediately after the tape conveying motor 2 stops normal rotation are formed with the identical line printing data so that regional width for printing out the said line printing data should approximate to the width to be occupied in case the tape conveying motor 2 keeps normal rotation for printing without temporary stop. In the case of (C) in FIG. 10, a sum of conveying directional width of the array of half dots to be printed with line printing data A and conveying directional width of two dot arrays to follow the array of half dot is made to approximate to conveying directional width of one array of normal dots under 180 dpi printing mode.

As to the case of dot formation in the during-inverse-rotation printing process (refer to FIG. 12), two arrays of dots (two white dots in FIG. 10) aligned in printing direction during reverse rotation are the dot arrays to be formed in the during-inverse-rotation printing process at any examples in FIG. 10. In such cases, the two arrays of white dots may be printed out so as to overlap on a part of the printing portion formed before inverse rotation as exemplary indicated at each case in FIG. 10 or may be printed out at portion that shifts to upstream of the conveying direction in comparison with the printing portion formed before inverse rotation. However, matters such as the timing to form above such dot arrays, time of printing cycle thereof and determination on which line printing data to be printed during reverse rotation are controlled depending on scheduled printing region of each line printing data.

Further, as to the case of dot formation in the resume-printing process to be executed when the tape conveying motor 2 resume normal rotation, the thermal head 41 resumes printing so as to overlap on at least the last one of dot arrays formed by the time of temporary stop of printing and print out each line printing data in the scheduled printing region.

In FIG. 10, the thermal head 41 is configured to resume printing so as to overlap on the last one of dot arrays formed by the time of temporary stop of printing. However, the thermal head 41 may be configured to resume printing so as to overlap on two or more of rearmost dot arrays, as will be described later.

For explaining the above situation with (A) in FIG. 10, line printing data C is printed to form the last dot array among dot arrays formed by the time of temporary stop of printing. The first dot array to be formed after the tape conveying motor 2 resumes normal rotation is printed with line printing data C, which is identical to the last dot array, as an array of normal dots under 360 dpi printing mode. Further, the line printing data C is the second line printing data counted from the line printing data A of which a corresponding dot array is formed before the tape conveying motor 2 stops normal rotation. Accordingly, the line printing data C is regarded as line printing data printed out on a printing line a that is the second one counted from the printing line a where the line printing data A is printed out in the direction reverse to the tape conveying direction.

As for the examples (B) and (C) in FIG. 10, line printing data B is printed to form the last dot array among dot arrays formed by the time of temporary stop of printing. The first dot array to be formed after the tape conveying motor 2 resumes normal rotation is printed with line printing data B, which is identical to the last dot array, as an array of normal dots under 180 dpi printing mode. Further, the said first dot array is formed on a printing line b that is next, in the direction reverse to the tape conveying direction, to a printing line b where the line printing data A is to be printed out (or formed so as to occupy two printing lines a that are next, in the direction reverse to the tape conveying direction, to two printing lines a where the line printing data A is to be printed out).

As for the exemplary printing under 180 dpi printing mode at (B) in FIG. 10, printing operation is resumed from a position that is shifted by a conveying directional length of a half dot back in the conveying direction in comparison with the cases of under 180 dpi half dot printing mode ((C) in FIG. 10) and under 360 dpi printing mode ((A) in FIG. 10). It is because resuming of printing operation from a position the same as the resuming position for 360 dpi printing ((A) in FIG. 10) and 180 dpi half-dot printing ((C) in FIG. 10) could overreach the scheduled printing region of the line printing data B.

As described in detail, according to the printer directed to the first and second embodiments, each dot array is formed on each printing line a provided at intervals obtained by dividing an inch on the surface tape 31 by a numeral of 360 in case of 360 dpi resolution. On the other hand, in case of printing with 180 dpi resolution, each dot array is formed so as to occupy plural printing lines a. In case the control unit 60 detect that the number of dot-array-formed first printing lines a from start of printing till temporary stop of printing for cutting off a front margin is not equal to the number of dot-array-formed printing lines under 360 dpi printing mode, a portion of dot arrays to be formed from the start of printing till the temporary stop of printing is formed with 360 dpi on that the number of the dot-array-formed printing lines a from the start of printing till the temporary stop of printing is made equal to the number of dot-array-formed printing lines a for printing under 360 dpi printing mode. Thereby, printing length from the start of printing till the temporary stop of printing with 180 dpi can be made almost equal to printing length for printing under 360 dpi printing mode. A length of a front margin is determined depending on the printing length from the start of printing till the temporary stop of printing, which can resolve the problem that length of a front margin to be cut off differs depending on under 360 dpi printing mode or 180 dpi printing mode.

Further, according to the printer directed to the first and second embodiments, the dot to be formed with 360 dpi even under 180 dpi printing mode is either a dot array to be printed at the start of printing while the tape conveying motor 2 is accelerated or last dot array to be printed immediately before the temporary stop of printing while the tape conveying motor 2 is decelerated. Therefore, switching from dot forming with 180 dpi to 360 dpi can be carried out during low-speed printing operation, which can get rid of burden to a CPU. Further, installation of a high-performance CPU is not required and manufacturing const of the printer can be lowered.

Further, the printing head is a thermal head. The thermal head can prevent the printing quality deterioration problem due to improper temperature of heater elements not sufficiently heated up or cooled down in case printing mode is switched to 360 dpi during high-speed printing.

Further, according to the printer directed to the second embodiment, the tape conveying motor 2 inversely rotates before the temporary stop of printing. Further, when the tape conveying motor 2 resumes normal rotation, the thermal head 41 resumes printing so as to overlap on at least the last one of dot arrays formed by the time of temporary stop of printing. Therefore, this mannered printing operation prevents appearance of a white line. Further, when the tape conveying motor 2 resumes normal rotation, each line printing data is printed out on a printing region identical to a printing region that is supposed to be printed in case the tape conveying motor 2 keeps normal rotation for printing on the printing region without the temporary stop of printing. Therefore, there can be obtained good resultant printing that looks almost the same as printing obtained in case the tape conveying motor 2 keeps normal rotation.

Further in the printer directed to the second embodiment, during printing operation under 180 dpi printing mode, among all the dot arrays formed from the start of printing till the temporary stop of printing, the last dot array to be formed immediately before the tape conveying motor 2 stops normal rotation is formed with 360 dpi. Therefore, resolution switching can be carried out when the tape conveying motor 2 rotates at the lowest speed, which can get rid of burden to a CPU. Still further, one or more dot arrays formed so as to follow the array of half dots at predetermined moment(s) immediately after the tape conveying motor 2 stops normal rotation, are printed in accordance with line printing data identical with the line printing data of the arrays of half dots so as to make regional width for the line printing data approximate to regional width that is supposed to be occupied in case the tape conveying motor 2 keeps normal rotation without temporary stop of printing. Accordingly, even though the resolution is switched for forming the array of half dots, skew of resultant printing can surely be prevented. That is, there can be obtained good resultant printing that looks almost the same as printing that is supposed to be obtained in case the tape conveying motor 2 keeps normal rotation without temporary stop of printing.

While presently exemplary embodiments of the disclosure have been shown and described, it is to be understood that this disclosure is for the purpose of illustration and that various changes and modifications may be made without departing from the scope of the disclosure as set forth in the appended claims.

For instance, in the embodiments, an array of dots under 180 dpi printing mode as example of the second resolution is formed so as to occupy two printing lines for 360 dpi as example of the first resolution. However, in the disclosure, an array of dots with the second resolution may be formed so as to occupy three or more printing lines for the first resolution. In such a case, "a portion of serial arrays of dots to be formed from the start printing till the temporary stop of printing with the second resolution is formed with the first resolution" means not only a situation to form and print out n-arrays of clots with the first resolution as replacement of n-arrays of dots with the second resolution, i.e., it does not always mean that the number of dot arrays to be switched from the second resolution to the first resolution is one-to-one relation; but also includes a situation to convert n-arrays of dots with the second resolution into 2n-arrays of dots with the first resolution, for instance. It is to be noted "n" used herein stands for an arbitrary integer number.

Further, in the embodiments, the disclosure is embodied as a thermal printer wherein thermal transfer system is realized by transferring an ink layer of an ink ribbon onto a printing medium. The disclosure, however, may be applicable to a thermal printer employing thermal paper or an ink jet printer.

Still further, a stepping motor is employed as tape conveying motor 2 in the embodiments. However, a DC motor may be employed for the printer as long as additional mechanism for accurately controlling tape conveying amount is furnished.

Not to mention, timing to form dot arrays in the second embodiment is not restricted to examples indicated in FIG. 10. For instance, although dot arrays are formed during inverse rotation of the tape conveying motor 2 in the second embodiment, dot arrays do not need to be formed during inverse rotation. Further, the number of dot arrays to be formed during the motor's resting is not restricted to four. Further, the number of line printing data to be printed out during the motor's resting is not restricted to two like line printing data B, C for the case of (A) in FIG. 10, but may be changed like 1, 3, 4 . . . .

Still further, dot arrays to be formed after printing operation is resumed may be formed an as to overlap on at least a dot array last printed among all the dot arrays formed until the temporary stop of printing. Accordingly, the first dot array after printing is resumed does not always need to be printed out with line printing data identical to the line printing data of the dot array last printed by the time of temporary stop of printing. That is, the first dot array after printing is resumed may be printed with line printing data identical to line printing data of dot array prior to the last dot array as long as each dot array is printed within a scheduled printing region.

What is claimed is:

1. A printer comprising:

a conveyer unit for conveying a printing medium that is long sized;

a printing head for carrying out printing on the printing medium that is conveyed, the printing being carried out by forming each array of dots aligned on each of a plurality of printing lines, the printing lines being in orthogonal direction to a conveying direction and provided at intervals obtained by dividing a unit length of the printing medium by resolution; and a cutter that is arranged at downstream of the conveying direction in comparison with the printing head, wherein the printing head carries out temporary stop of printing for allowing the cutter to cut off a front margin of the printing medium, the front margin being formed so as to start from a point of a start of printing in a direction reverse to a printing direction, wherein the resolution includes first resolution and second resolution, first printing lines are provided at intervals obtained by dividing the unit length by a numerical value of the first resolution and a dot array with the second resolution is formed so as to occupy two or more of first printing lines, wherein the printer further comprises a judgment unit that judges whether or not number of dot-array-formed first printing lines from the start of printing till the temporary stop of printing with the second resolution is equal to number of dot-array-formed first printing lines in printing with the first resolution, each of the dot-array-formed first printing lines being a first printing lines on which an array of full-dots or an array of dot portions is formed, and wherein, in case the judgment unit judges that the number of the dot-array-formed first printing lines in printing with the second resolution is not equal to the number of the dot-array-formed first printing lines in printing with the first resolution, a portion of serial arrays of dots to be formed from the start printing till the temporary stop of printing with the second resolution is formed with the first resolution so that the number of the dot-array-formed first printing lines is made equal to the number of the dot-array-formed first printing lines in printing with the first resolution.

2. The printer according to claim 1, wherein the printing head is a thermal head consisting of a plurality of heater elements aligned orthogonally with reference to the conveying direction, the plurality of heater elements being heated in response to electrical conduction, wherein the conveyer unit includes a conveying motor, and wherein the portion of serial arrays of dots is either front portion dot array(s) or end portion dot array(s), the front portion dot array(s) being one or more dot arrays to be printed on the printing medium at the start of printing while rotation of the conveying motor is accelerated and the end portion dot array(s) being one or more dot arrays to be last printing on the printing medium immediately before the temporary stop of printing while the rotation of the conveying motor is decelerated.

3. The printer according to claim 1, wherein the conveyer unit includes a conveying motor that is capable of normal rotation and inverse rotation, the conveying motor carrying out the inverse direction for the temporary stop of printing, wherein, when the conveying motor resumes the normal rotation, the printing head resumes printing so as to overlap on at least last one of dot arrays formed by the time of the temporary stop of printing and prints out each line printing data on a printing region identical to a printing region that is supposed to be printed in case the conveying motor keeps the normal rotation for printing on the printing region without the temporary stop of printing, wherein the portion of serial arrays of dots is a first dot array that is to be formed immediately before the conveying motor stops the normal rotation, and wherein one or more second dot arrays are formed so as to follow the first dot array at predetermined moment(s) immediately after the conveying motor stops the normal rotation, the one or more second arrays being formed by printing out line printing data which is identical in forming the first dot array so as to make regional width for the line printing data of the first dot array approximate to regional width that is supposed to be occupied in case the conveying motor keeps the normal rotation for printing without temporary stop of printing.

4. The printer according to claim 2, wherein the conveyer unit includes the conveying motor that is capable of normal rotation and inverse rotation, the conveying motor carrying out the inverse direction for the temporary stop of printing, wherein, when the conveying motor resumes the normal rotation, the printing head resumes printing so as to overlap on at least last one of dot arrays formed by the time of the temporary stop of printing and prints out each line printing data on a printing region identical to a printing region that is supposed to be printed in case the conveying motor keeps the normal rotation for printing on the printing region without the temporary stop of printing, wherein the portion of serial arrays of dots is a first dot array that is to be formed immediately before the conveying motor stops the normal rotation, and wherein one or more second dot arrays are formed so as to follow the first dot array at predetermined moment(s) immediately after the conveying motor stops the normal rotation, the one or more second arrays being formed by printing out line printing data which is identical in forming the first dot array so as to make regional width for the line printing data of the first dot array approximate to regional width that is supposed to be occupied in case the conveying motor keeps the normal rotation for printing without temporary stop of printing.

* * * * *